US007358020B2

(12) United States Patent
Shida et al.

(10) Patent No.: US 7,358,020 B2
(45) **Date of Patent: *Apr. 15, 2008**

(54) IMAGE FORMING APPARATUS AND IMAGE FORMING METHOD

(75) Inventors: Kazuhisa Shida, Hachioji (JP); Kageyuki Tomoyori, Hachioji (JP); Hirofumi Hayata, Hachioji (JP); Masao Asano, Hachioji (JP); Tomoe Kitani, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 414 days.

This patent is subject to a terminal disclaimer.

(21) Appl. No.: 10/939,057

(22) Filed: Sep. 10, 2004

(65) Prior Publication Data

US 2005/0064318 A1 Mar. 24, 2005

(30) Foreign Application Priority Data

Sep. 18, 2003 (JP) ..... 2003-325886

(51) Int. Cl.
*G03G 13/14* (2006.01)

(52) U.S. Cl. ..... 430/125.3; 430/108.1; 430/125.5

(58) Field of Classification Search ..... 430/126, 430/108.1, 125.3, 125.5; 399/252
See application file for complete search history.

(56) References Cited

U.S. PATENT DOCUMENTS

| | | | | |
|---|---|---|---|---|
| 5,155,000 | A | 10/1992 | Matsumura et al. | |
| 5,430,526 | A | 7/1995 | Ohkubo et al. | |
| 5,744,271 | A | 4/1998 | Aizawa et al. | |
| 5,763,127 | A | 6/1998 | Goshima et al. | |
| 5,965,311 | A | 10/1999 | Suzuki | |
| 6,355,390 | B1 | 3/2002 | Yamanami et al. | |
| 6,399,263 | B1 | 6/2002 | Hayata | |
| 6,531,231 | B1 | 3/2003 | Ito et al. | |
| 2003/0118927 | A1 | 6/2003 | Nakamura et al. | |
| 2003/0219666 | A1* | 11/2003 | Kitani et al. | 430/108.1 |
| 2003/0224276 | A1* | 12/2003 | Tsuji et al. | 430/109.3 |
| 2004/0259009 | A1 | 12/2004 | Itama et al. | |
| 2006/0029878 | A1* | 2/2006 | Yoshizawa et al. | 430/124 |

FOREIGN PATENT DOCUMENTS

| | | |
|---|---|---|
| JP | 05-080567 | 4/1993 |
| JP | 09166882 | 6/1997 |
| JP | 095258468 | 10/1997 |
| JP | 2000-199990 | 7/2000 |
| JP | 2000221719 | 8/2000 |
| JP | 2002107983 | 4/2002 |
| JP | 2003149845 | 5/2003 |
| JP | 2004101800 | 4/2004 |

* cited by examiner

*Primary Examiner*—Mark A. Chapman
(74) *Attorney, Agent, or Firm*—Lucas & Mercanti, LLP

(57) ABSTRACT

An image forming apparatus for enabling an image forming which is stable for a long time, by using a charging method in which the amount of generated ozone or nitrogen oxides is reduced and consumed electric power is low. An image forming method includes: a charging section for charging a photoreceptor by contacting on the photoreceptor; an exposure section for forming a static latent image on the photoreceptor by an exposure; a developing section for developing a toner image on the static latent image by a toner having a toner particle which uses a binder resin and a colorant as a component, in which a total quantity of a volatile material measured by a headspace method is 350 ppm or less; and a transfer section for transferring the toner image on a transfer material.

20 Claims, 1 Drawing Sheet

IMAGE FORMING APPARATUS AND IMAGE FORMING METHOD

BACKGROUND

1. Technical Field

The present invention relates to an image forming apparatus and an image forming method for use in electrophotographic image formation. More specifically, the present invention relates to an image forming apparatus and an image forming method for use in electrophotographic image formation, which are used in a field of copying machines or printers.

2. Description of Related Art

An organic photoreceptor is greatly advantageous in that the selection range of materials is wide, the environmental suitability is excellent, the production cost is low, and the like, as compared with an inorganic photoreceptor such as a selenium photoreceptor or an amorphous silicon photoreceptor. Recently, the main stream of the electrophotographic photoreceptors is shifted to organic photoreceptors in place of inorganic photoreceptors.

On the other hand, in image forming methods according to Carlson method, the electrophotographic photoreceptor is charged to form thereon a static latent image, the static latent image is visualized to form a toner image, and the toner image is transferred to transfer paper and fixed, whereby a final image is formed.

A corona discharger is best known for a charging member conventionally used typically as a member of the charging means. The corona discharger has an advantage in that stable charging can be carried out. However, the corona discharger has problems in that high voltage must be applied and therefore, ionized oxygen, ozone, moisture, nitrogen oxide compounds and the like are largely generated, as a result, deterioration of an organic photoreceptor (hereinafter, also refers to as a photoreceptor) is incurred or adverse effects are caused on human bodies.

Consequently, employment of a contact charging method using no corona discharger is recently considered. More specifically, the contact charging method is a system in which a magnetic brush or an electroconductive roller as a charging member is brought into contact with a photoreceptor as a body to be charged while applying a voltage to the brush or the roller and thereby a surface of the photoreceptor is charged to have a predetermined potential. When using such a contact charging method, an applied voltage is reduced and an ozone generation amount is decreased, as compared with a non-contact charging method using a corona discharger.

The contact charging method is a method in which a charging member having a resistance of about from $10^2$ to $10^{10}$ Ω·cm is brought into contact with a photoreceptor under pressure while impressing a DC voltage formed by superposing DC or AC to the member and thereby charges are imparted to the photoreceptor. The charging method is carried out by discharge from a charging member to a body to be charged, in accordance with a Paschen's law and therefore, the charging is started by impressing a voltage of certain threshold or more. When using this contact charging method, an impressed voltage to the charging member is reduced and a generation amount of ozone and nitrogen oxides is decreased, as compared with the corona charging method.

However, when the charging is repeatedly performed on the surface of an electrophotographic photoreceptor by a direct contact with the charged roller, etc., tiny asperities or contaminants occur on the electrophotographic photoreceptor. As a result, charges concentrate at the asperities or contaminants, which readily causes formation of image defects such as dielectric breakdown or black spots and occurrence of image blurring. These problems readily occur, in particular, under strict conditions of high temperature and high humidity, or low temperature and low humidity.

Further, a cleaner-less image forming apparatus using no cleaning blade for removing residual toners on the photoreceptor with the contact charging is disclosed (JP-Tokukai-2000-199990A). The image forming apparatus has auxiliary charging section in addition to the charging section. The auxiliary section has a function of charging residual toners and enhancing recovery efficiency of the residual toners by developing section. On the contrary, when the auxiliary charging section is provided, the above-described dielectric breakdown or black spot is more readily caused.

It is proposed that in order to prevent formation of the above-described image defects such as dielectric breakdown or black spot, an aluminum substrate surface of a conductive support is subjected to alumite treatment to enhance a resistance force to charge leakage of the electrophotographic photoreceptor, and even if asperities or contaminants occur on the photosensitive layer, the charge leakage from the conductive support is prevented (JP-Tokukaihei-5-80567A).

However, the electrophotographic photoreceptor using the alumite treated aluminum substrate has a problem that an alumite layer is deteriorated due to the alumite treatment and a subsequent slight change of aging conditions, and as a result, an effect of preventing the above-described charge leakage is hardly obtained stably. In addition thereto, the photoreceptor has a problem that a portion between an alumite layer and a photosensitive layer is readily made to function as a charge trap site and residual potential tends to be gradually accumulated due to a long-term use.

An object of one aspect of the invention can be to provided an image forming apparatus and an image forming method, where a charging method of reducing the generation amount of ozone or nitrogen oxides and consuming small electric power is used and stable image formation can be performed for a long time.

Another object of one aspect of the invention can be to provide an image forming apparatus and an image forming method, in which an organic photoreceptor is used for an electrophotographic photoreceptor for use in the image forming apparatus employing a contact charging method, deterioration in electrophotographic characteristics (e.g., sensitivity or residual potential), which is readily generated while the organic photoreceptor is repeatedly used, is prevented, formation of image defects such as dielectric breakdown or black spots is prevented, and stable image formation exhibiting excellent sharpness can be performed for a long time.

SUMMARY

In accordance with a first aspect of the invention, an image forming method comprises:

charging a photoreceptor by contacting with a charging section on the photoreceptor;

forming a static latent image on the photoreceptor by an exposure;

forming a toner image on the photoreceptor by a toner comprising a toner particle containing a binder resin and a colorant as components, in which a total quantity of a volatile material measured by a headspace method is 350 ppm or less; and transferring the toner image on a transfer material.

In accordance with a second aspect of the invention, an image forming apparatus comprises:

a charging section for charging a photoreceptor by contacting on the photoreceptor;

an exposure section for forming a static latent image on the photoreceptor by an exposure;

a developing section for developing a toner image on the static latent image by a toner comprising a toner particle containing a binder resin and a colorant as components, in which a total quantity of a volatile material measured by a headspace method is 350 ppm or less; and a transfer section for transferring the toner image on a transfer material.

BRIEF DESCRIPTION OF THE DRAWINGS

The present invention will become more fully understood from the detailed description shown hereinafter and the accompanying drawing, and thus are not intended as a definition of the limits of the present invention, and wherein.

DETAIL DESCRIPTION OF EXEMPLARY EMBODIMENTS

Figure 1:
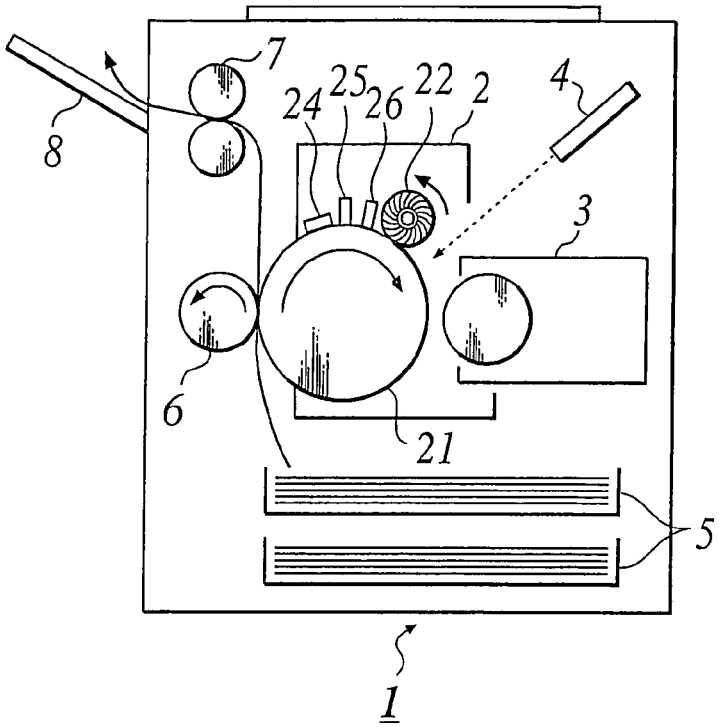
FIG. 1 is a schematic cross sectional view of an image forming apparatus 1 employing the contact charging method.

As a result of extensive investigations to solve the above-described peculiar problems on the image forming apparatus employing a contact charging method, the present inventors have found that when toner components readily adhering to a surface of an organic photoreceptor is reduced and the surface of the organic photoreceptor is always made to be a clean state, formation of dielectric breakdown or black spots due to charge leakage which is readily generated in the image forming apparatus employing a contact charging method is suppressed, electrophotographic characteristics such as charging potential or residual potential is stably obtained when the photoreceptor is repeatedly used, and the charge leakage is hardly generated even if charging means or auxiliary charging means comes in contact with the organic photoreceptor. More specifically, the present inventors have found that when using a toner containing a large amount of volatile components or residual monomers in the toner component, dielectric breakdown or black spots are readily generated on the organic photoreceptor in the contact charging method having both of the contact charging section and the auxiliary charging section.

In the first aspect, the image forming apparatus comprises the charging section for charging the photoreceptor by contacting on the photoreceptor, the exposure section for forming the static latent image on the photoreceptor by an exposure, the developing section for developing the toner image on the static latent image, the transfer section for transferring the toner image on the transfer material, wherein the electrophotographic photoreceptor means an organic photoreceptor, the toner used in the developing section contains the toner particle having the binder resin and the colorant as component, and the total quantity of the volatile material in the toner measured by a headspace method is 350 ppm or less.

In the second aspect, the image forming apparatus comprises the charging section for charging the photoreceptor by contacting on the photoreceptor, the exposure section for forming the static latent image on the photoreceptor by an exposure, the developing section for developing the toner image on the static latent image, the transfer section for transferring the toner image on the transfer material, at least one or more auxiliary charging section for charging the toner on the surface of the electrophotographic photoreceptor, the auxiliary charging section being disposed in an upstream from the charging section, wherein the electrophotographic photoreceptor means an organic photoreceptor, the toner used in the developing section contains the toner particle having the binder resin and the colorant, and the total quantity of the volatile material in the toner measured by a headspace method is 350 ppm or less.

The third aspect is the image forming method performed by the image forming apparatus in the above described first and second aspects.

In the first aspect to the third aspect, a quantity of polymerizable monomer of the toner can be 50 ppm or less The construction of the electrophotographic photoreceptor, the toner and the image forming apparatus is described below.

The organic photoreceptor means an electrophotographic photoreceptor constructed by allowing an organic compound to have at least one function of a charge generating function and a charge transport function which are necessary to the construction of the electrophotographic photoreceptor, and examples thereof include any known organic electrophotographic photoreceptor such as a photoreceptor composed of a known organic charge generating material or a known organic charge transport material and a photoreceptor composed of polymer complex having a charge generating function and a charge transport function.

The charge transport layer means a layer having a function of transporting a charge carrier generated in a charge generating layer through light exposure to a surface of the organic photoreceptor. When the charge generating layer and the charge transport layer are stacked on a conductive support to detect photoconductivity, the charge transport function can be specifically recognized.

The organic photoreceptor has a conductive support and at least an interlayer, a charge generating layer and a charge transport layer on the conductive support are formed. It is preferred that a film thickness of the interlayer is from 5 to 25 μm and a film thickness of the charge transport layer is from 5 to 20 μm.

In the organic photoreceptor used in the contact charging method, charges tend to concentrate at the asperities or contaminants generated on the organic photoreceptor as described above, and as a result, formation of image defects such as dielectric breakdown or black spots is readily caused and image blurring readily occurs. In order to prevent concentration of charges, which is peculiar to such a contact charging method, it is important to reduce an electric field strength per unit film thickness of the photosensitive layer and to prevent charge leakage even if asperities or contaminants occur on the photoreceptor surface. In order to reduce the electric field strength per unit film thickness of the photosensitive layer, the embodiments adopts the construction that the organic photoreceptor has at least an interlayer, a charge generating layer and a charge transport layer on the conductive support. When the film thickness of the interlayer is from 5 to 25 μm and the film thickness of the charge transport layer is from 5 to 20 μm, the electric field strength of the photosensitive layer, particularly, the charge transport layer is reduced, so that dielectric breakdown or black spots can be prevented and an organic photoreceptor ensuring a stable residual potential or charged potential and ensuring excellent sharpness can be provided.

When the film thickness of the interlayer is more than 5 μm, generating dielectric breakdown or black spots are readily prevent, whereas when the film thickness is not more than 25 μm, image blurring readily and deterioration of sharpness are readily prevent. On the other hand, when the film thickness of the charge transport layer is more than 5 μm, generating dielectric breakdown or black spots are readily prevent, whereas when the film thickness is not more than 20 μm, image blurring and deterioration of sharpness is readily prevent. The film thickness of the interlayer is more preferably from 7 to 15 μm. Further, the film thickness of the charge transport layer is more preferably from 8 to 18 μm.

The interlayer preferably contains metal oxide particles. Examples of the metal oxide particles include cerium oxide, chromium oxide, aluminum oxide, magnesium oxide, silicon oxide, tin oxide, zirconium oxide, iron oxide and titanium oxide. Among these, titanium oxide ($TiO_2$), zinc oxide (ZnO), aluminum oxide ($Al_2O_3$) and zirconium oxide ($ZrO_2$) are preferably used, and titanium oxide is particularly preferably used.

Further, these metal oxide particles may be preferably subjected to a hydrophobilizing treatment by a hydrophobilizing agent such as a titanium coupling agent, a silane coupling agent and a high molecular weight fatty acid or a metal salt thereof.

When these metal oxide particles are incorporated into the interlayer, image defects such as dielectric breakdown or black spots, and image blurring, which are readily generated by the contact charging method, are prevented from occurring, so that an organic photoreceptor having a stable performance for a long period of time can be provided.

The metal oxide particle is preferably a fine particle having a number average primary particle diameter of from 5 to 400 nm, particularly preferably from 10 to 200 nm. The number average primary particle diameter is a value of Feret's direction number average diameter measured by image analysis of 100 particles as the primary particles which are magnified 10,000 times by a transmission electron microscope and randomly observed.

The crystal type of the titanium oxide particle includes an anatase-type, a rutile-type, brookite-type and an amorphous-type. Among these, an anatase-type titanium oxide pigment is most preferred as particles.

In the embodiments, preferred is the anatase-type titanium oxide pigment containing a niobium element in an amount of 100 ppm to 2.0% by mass in the interlayer. When a niobium element is incorporated into the anatase-type titanium oxide pigment in this range, the rectifying property in the anatase-type titanium oxide pigment is stably exerted even during using the photoreceptor for a long period of time, formation of dielectric breakdown or black spots is prevented and fluctuation in charging characteristics or sensitivity characteristics is small even if the environmental conditions of temperature and humidity are changed.

The content of niobium element in the anatase-type titanium oxide pigment is more preferably from 300 ppm to 1.8% by mass.

The niobium element concentration in the whole anatase-type titanium oxide particles can be quantitatively analyzed by ICP (an induction coupling plasma emission analysis method).

The anatase-type titanium oxide pigment can be produced by a publicly known sulfuric acid method. More specifically, a solution containing titanium sulfate or titanyl sulfate is heated and hydrolyzed to prepare a hydrated titanium dioxide slurry and then, the titanium dioxide slurry is dehydrated and baked to obtain the anatase-type titanium oxide pigment. A method for producing the anatase-type titanium oxide pigment containing a niobium element is described below.

First, niobium sulfate (a water-soluble niobium compound) is added to a hydrated titanium dioxide slurry obtained by hydrolyzing an aqueous titanyl sulfate solution. The added amount of niobium sulfate as a niobium ion is suitably from 0.15 to 5% by mass based on the amount of titanium in the slurry (in terms of titanium dioxide). More specifically, there can be used (i) a hydrated titanium dioxide slurry obtained by adding from 0.15 to 5% by mass of niobium sulfate as a niobium ion into an aqueous titanyl sulfate solution and then, hydrolyzing the resulting solution, or (ii) a slurry obtained by adding from 0.15 to 5% by mass of niobium sulfate as a niobium ion to a hydrated titanium dioxide slurry obtained by hydrolyzing an aqueous titanyl sulfate solution.

The above-described hydrated titanium dioxide slurry containing a niobium ion, etc. is dehydrated and baked. In general, the baking temperature is suitably from 850 to 1100° C. When the baking temperature is less than 850° C., the baking is not sufficiently performed, while when it exceeds 1100° C., sintering of the particles is generated and dispersibility of the pigments is remarkably impaired. The niobium ions added to the slurry segregate on the surface of the particle during the baking and therefore, are contained in the surface layer in a large amount as a niobium oxide. By this production method, there can be obtained an anatase-type titanium oxide pigment having an average primary particle diameter of from 0.01 to 10 μm and containing a niobium element in an amount of 100 ppm to 2% by mass.

A method for forming a titanium oxide pigment by a gas sintering process using titanium tetrachloride can also be used. In this occasion, unless other metal halide components are incorporated into gas components as raw materials, an anatase-type titanium oxide pigment in which the content of other metal elements such as niobium is reduced to zero (other metal elements are scarcely incorporated) can also be produced.

The anatase degree of the anatase-type titanium oxide is preferably from 90 to 100%. According to the above-described method, an anatase-type titanium oxide having the anatase degree of almost 100% can be prepared. In addition, when the interlayer comprises an anatase-type titanium oxide containing a niobium element in this range, the rectifying property can be preferably and stably achieved, so that the above-described effects can be preferably achieved.

Herein, the anatase degree is a value determined by measuring the intensity IA in the strongest interference line (a plane index 101) of anatase and the intensity IR in the strongest interference line (a plane index 110) of rutile in the/powder X-ray diffraction of titanium oxide and using the following formula:

$$\text{Anatase degree (\%)}=100/(1+1.265\times IR/IA)$$

In order to prepare the titanium oxide having the anatase degree of from 90 to 100%, in the preparation of titanium oxide, when a solution containing titanium sulfate or titanyl sulfate as a titanium compound is heated and hydrolyzed, an anatase-type titanium oxide having the anatase degree of almost 100% can be obtained. Further, when a titanium tetrachloride aqueous solution is neutralized using an alkali, an anatase-type titanium oxide having a high anatase degree can be obtained.

The anatase-type titanium oxide pigment is preferably subjected to the surface treatment by the reactive organic silicon compound. The surface treatment of the anatase-type titanium oxide pigment by the reactive organic silicon compound can be performed by a wet method as described below. The surface treatment by the reactive organic silicon compound means a surface treatment using the reactive organic silicon compound as a treating solution.

Specifically, the anatase-type titanium oxide pigments are added to a solution which is prepared by dissolving or suspending the reactive organic silicon compound in an organic solvent or water, and this mixed solution is subjected to dispersion in a medium on the order of several minutes to a whole day and night. In some cases, this mixed solution is heated. Thereafter, the titanium oxide pigments are filtrated and dried. Thus, the anatase-type titanium oxide pigments where each surface is covered with the organic silicon compound are obtained. In addition, the reactive organic silicon compound may be added to a suspension prepared by dispersing the titanium oxide pigments in an organic solvent or water.

The amount of the reactive organic silicon compound to be used for the surface treatment is preferably from 0.1 to 10 parts by mass, more preferably from 0.1 to 5 parts by mass, based on 100 parts by mass of the anatase-type titanium oxide pigment in the charged amount at the surface treatment. When the amount of the compound to be used for the surface treatment is smaller than that in the above-described range, sufficient effect of the surface treatment cannot be imparted and the rectifying action or dispersibility of the titanium oxide particle within the interlayer is deteriorated, while when the amount of the compound to be used for the surface treatment exceeds the above-described range, the electrophotographic properties are deteriorated, and as a result, increase in residual potential or decrease in charged potential is incurred.

The reactive organic silicon compound for use in the embodiments includes compounds represented by the following Formula (1), however, the present invention is not limited to the following compounds as long as the compound can perform a condensation reaction with a reactive group such as a hydroxyl group on the surface of the titanium oxide.

$$(R)_n—Si—(X)_{4-n} \qquad \text{General Formula (1)}$$

(in general formula (1), Si represents a silicon atom, R represents an organic group in which a carbon atom directly bonds to the silicon atom, X represents a hydrolysable group, and n represents an integer of 0 to 3).

In the organic silicon compounds represented by General Formula (1), examples of the organic groups represented by R in which a carbon atom directly bonds to the silicon atom include an alkyl group such as methyl, ethyl, propyl, butyl, pentyl, hexyl, octyl and dodecil; an aryl group such as phenyl, tolyl, naphthyl and biphenyl; an epoxy containing group such as γ-glycidoxypropyl and β-(3,4-epoxycyclohexyl)ethyl; a methacryloyl containing group such as γ-acryloxypropyl and γ-methacryloxypropyl; a hydroxyl containing group such as γ-hydroxypropyl and 2,3-dihydroxypropyloxypropyl; a vinyl containing group such as vinyl and propenyl; a mercapto containing group such as γ-mercaptopropyl; an amino containing group such as γ-aminopropyl and N-β(aminoethyl)-γ-aminopropyl; a halogen containing group such as γ-chloropropyl, 1,1,1-trifluoropropyl, nonafluorohexyl and perfluorooctylethyl; and others such as a nitro- or cyano-substituted alkyl group. Examples of the hydrolysable group represented by X include an alkoxy group such as methoxy and ethoxy; a halogen group, and an acyloxy group.

The organic silicon compounds represented by General Formula (1) may be used individually or in combination of two or more types.

In the specific organic silicon compound represented by General Formula (1), when n is 2 or more, a plurality of groups represented by R may be the same or different from each other. When n is 2 or less, similarly, a plurality of groups represented by X may be the same or different from each other. Further, when two or more types of the organic silicon compound represented by General Formula (1) are used, R and X may be the same or different from each other between the different compounds.

Preferable examples of the reactive organic silicon compound include polysiloxane compounds. Among these, methylhydrogen polysiloxane is particularly preferable. The polysiloxane compound having a molecular weight of from 1,000 to 20,000 is easily available and shows an excellent black spot inhibiting ability.

Another surface treatment for the titanium oxide is a surface treatment by an organic silicon compound having a fluorine atom. The surface treatment by the organic silicon compound having a fluorine atom is preferably performed by the above-described wet method.

When using a combination of surface analysis means such as electron spectroscopy for chemical analysis (ESCA), Auger electron spectroscopy (Auger), secondary ion mass spectroscopy (SIMS) and scatter reflection FI-IR, it is confirmed that the surface of the titanium oxide particle is covered with the reactive organic silicon compound.

Another surface treatment for the anatase-type titanium oxide pigment includes a surface treatment by at least one or more compounds selected from alumina, silica and zirconia.

The treatment by alumina, silica or zirconia means a treatment for precipitating alumina, silica or zirconia on the surface of the anatase-type titanium oxide. The alumina, silica or zirconia precipitated on the surface includes also a hydrate of alumina, silica or zirconia.

The treatments by alumina and silica may be performed simultaneously, however, it is particularly preferable that the treatment by alumina is firstly performed and then the treatment by silica is performed. The treating amount of silica is preferably larger than that of alumina when the treatment by alumina and that by silica are each performed.

The surface treatment of the anatase-type titanium oxide by the metal oxide such as alumina, silica and zirconia may be performed by a wet method. For example, the anatase-type titanium oxide surface-treated by silica or alumina can be prepared by the following procedure.

When using the anatase-type titanium oxide, titanium oxide particles (number average primary particle diameter: 50 nm) are dispersed in water in a concentration of from 50 to 350 g/L to prepare an aqueous slurry, and a water-soluble silicate or a water-soluble aluminum compound is added to the slurry. Then the slurry is neutralized by the addition of an alkali or an acid to precipitate silica or alumina onto the surface of the titanium oxide particles. Thereafter, the particles are filtered, washed and dried to prepare the subjected surface-treated titanium oxide. When sodium silicate is used as the above-described water-soluble silicate, the slurry can be neutralized by an acid such as sulfuric acid, nitric acid and hydrochloric acid. On the other hand, when aluminum sulfate is used as the above-described water-soluble aluminum compound, the slurry can be neutralized by an alkali such as sodium hydroxide and potassium hydroxide.

The amount of the metal oxide to be used in the surface treatment is from 0.1 to 50 parts by mass, preferably from 1 to 10 parts by mass, based on 100 parts by mass of titanium oxide particles in the charging amount at the time of the surface treatment. In the above-described case of using alumina and silica for the surface treatment, for example, of anatase-type titanium oxide particles, it is preferable that alumina and silica are each used in an amount of from 1 to 10 parts by mass based on 100 parts by mass of titanium oxide particles, and that silica is preferably used in a larger amount than alumina.

It is preferable that the interlayer is substantially an insulating layer. The insulating layer used herein is one having a volume resistivity of $1\times10^{8}$ Ω·cm or more. The interlayer and the protective layer have preferably a volume resistivity of from $1\times10^{8}$ to $1\times10^{15}$ Ω·cm, more preferably from $1\times10^{9}$ to $1\times10^{14}$ Ω·cm, still more preferably from $2\times10^{9}$ to $1\times10^{13}$ Ω·cm. The volume resistivity can be measured as follows.

Measurement conditions: According to JIS C2318-1975

Measuring device: Hiresta IP manufactured by Mitsubishi Petrochemical Co., Ltd.

Measurement conditions: measurement probe HRS

Applied voltage: 500 V

Measurement environment: 30±2° C., 80±5 RH %

By defining volume resistivity as the above-described range, all or some effects of prevention of decline of charge blocking property of the interlayer, prevention of increase of formation of black spots, prevention of deterioration potential-holding property of the electrophotographic photoreceptor, prevention of increase of the residual potential during repetitive image formation can be readily obtained and an excellent image can be obtained.

An interlayer coating liquid prepared for forming the interlayer is composed of the metal oxide particle such as the surface-treated titanium oxide, a binder resin, a dispersion solvent and the like.

In the interlayer, the metal oxide particle is included in a binder resin at a ratio of from 10 to 10,000 parts by mass, preferably from 50 to 1,000 parts by mass, based on 100 parts by mass of the binder resin. When the metal oxide particle is used in this range, the dispersibility of the metal oxide particle can be suitably maintained and dielectric breakdown or black spots can be prevented from occurring, so that an excellent interlayer having small potential fluctuation can be formed.

On the other hand, the binder resin for dispersing these particles and for forming a layer structure of the interlayer is preferably a polyamide resin and particularly preferably a polyamide resin described below, in order to obtain excellent dispersibility of the particles.

Specifically, a polyamide resin having heat of fusion of 0 to 40 J/g and a water absorption coefficient of 5% by mass or less is preferably used for the binder resin in the interlayer. The heat of fusion is more preferably from 0 to 30 J/g, most preferably from 0 to 20 J/g. On the other hand, when the water absorption coefficient exceeds 5% by mass, water content in the interlayer is elevated, dielectric breakdown or black spots readily occur, and deterioration in electrophotographic properties such as increase in residual potential and formation of fog is caused. The water absorption coefficient is more preferably 4% by mass or less.

The heat of fusion of the resin is measured by DSC (Differential Scanning Calorimetry). However, the measurement method is not limited to the DSC measurement method as long as the same measurement values as that by DSC are obtained. The heat of fusion is determined from a heat-absorption peak area at the temperature rising in DSC.

On the other hand, the water absorption coefficient of the resin is determined by the mass change according to a water-immersion method or by the Karl-Fischer's method.

The binder resin for the interlayer is preferably an alcohol-soluble polyamide resin. As the binder resin for the interlayer in the electrophotographic photoreceptor, a resin having excellent solvent solubility is required to form an interlayer having a uniform film thickness. As such an alcohol-soluble polyamide resin, there is known a copolymer polyamide resin or methoxymethylated polyamide resin comprising a chemical structure having a small number of carbon chains between amide bonds such as 6-nylon described above. However, since these resins are high in a water absorption coefficient, the interlayer formed by using such polyamide has a tendency to be increased in the environmental dependency. As a result, for example, charging characteristics or sensitivity easily changes under the environmental conditions of high temperature and high humidity or low temperature and low humidity, and the formation of dielectric breakdown or black spots is easily caused.

In the alcohol-soluble polyamide resin, when the defects as described above are improved and properties such as fusion heat of from 0 to 40 J/g and a water absorption coefficient of 5% by mass or less are imparted, defects of conventional alcohol-soluble polyamide resins are improved and an excellent electrophotographic image can be obtained even if external environments are changed or the organic photoreceptor is continuously used for a long time.

The alcohol-soluble polyamide resin having properties such as heat of fusion of 0 to 40 J/g and a water absorption coefficient of 5% by mass or less is described below.

As the alcohol-soluble polyamide resin, a polyamide resin containing a repeating unit structure having 7 to 30 carbon atoms between amide bonds at a ratio of 40 to 100% by mol based on the total repeating unit structure is preferred.

Here, the repeating unit structure having 7 to 30 carbon atoms between amide bonds is described. The repeating unit structure means an amide bond unit forming a polyamide resin. This is described by referring to both examples of a polyamide resin (type A) in which the repeating unit structure is formed by condensation of a compound having both an amino group and an carboxylic acid group, and a polyamide resin (type B) in which the repeating unit structure is formed by condensation of a diamino compound and a dicarboxylic acid compound.

More specifically, the repeating unit structure of type A is represented by Formula (2) and the number of carbon atoms contained in X is the number of carbon atoms of the amide bond unit in the repeating unit structure. On the other hand, the repeating unit structure of type B is represented by Formula (3), and the number of carbon atoms contained in Y and the number of carbon atoms contained in Z each is the number of carbon atoms of the amide bond unit in the repeating unit structure.

General formula (2)

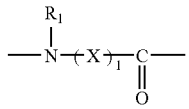

In Formula (2), $R_1$ represents a hydrogen atom, or a substituted or non-substituted alkyl group, X represents a substituted or non-substituted alkylene group, a group containing a divalent cycloalkane or a divalent aromatic group and a mixed structure thereof, and 1 represents a natural number.

General formula (3)

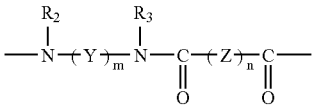

In Formula (3), $R_2$ and $R_3$ represent each hydrogen atom, or a substituted or non-substituted alkyl group, Y and Z represent each substituted or non-substituted alkylene group, a group containing a divalent cycloalkane or a divalent aromatic group and a mixed structure thereof, and m,n represent a natural number.

As described above, the repeating unit structure having 7 to 30 carbon atoms includes a chemical structure having a substituted or non-substituted alkylene group, a group containing a divalent cycloalkane, a divalent aromatic group and a mixed structure thereof. Among these, a chemical structure having a group containing a divalent cycloalkane is preferred.

In the polyamide resin of the embodiments, the number of carbon atoms between amide bonds in the repeating unit structure is from 7 to 30, preferably from 9 to 25, more preferably from 11 to 20. Further, the repeating unit structure having from 7 to 30 carbon atoms between amide bonds occupies 40 to 100% by mol, preferably 60 to 100% by mol, more preferably 80 to 100% by mol, of the total repeating unit structure.

If the number of carbon atoms is less than 7, the polyamide resin has large hygroscopicity and therefore, humidity dependency in electrophotographic properties, particularly, in potential during repeated use is large and further, image defects such as black spots are easily caused. If the number of carbon atoms is more than 30, the polyamide resin is hardly dissolved in a coating solvent and is not suitable for forming a coating film of the interlayer.

Further, when the repeating unit structure having 7 to 30 carbon atoms between amide bonds occupies less than 40% by mol of the total repeating unit structure, the above-described effects are reduced.

For the preferred polyamide resin of the embodiments, a polyamide having a repeating unit structure represented by the following Formula (4) is included.

General formula (4)

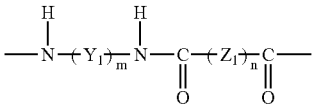

In Formula (4), $Y_1$ represents a group containing a divalent alkyl-substituted cycloalkane, $Z_1$ represents a methylene group, m represents a natural number of 1 to 3 and n represents a natural number of 3 to 20.

In the Formula (4), $Y_1$ which represents a group containing a divalent alkyl-substituted cycloalkane has preferably the following chemical structure. Specifically, when using the polyamide resin of the embodiments in which $Y_1$ has the following chemical structure, improvement effects on black spots are remarkable.

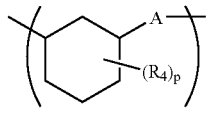

In the above chemical structure, A represents a single bond or alkylene group with a number of carbon atoms of 1 to 4, $R_4$ represents a substituted alkyl group and p represents the natural number of 1 to 5. However, a plurality of $R_4$ may be the same or different.

Specific examples of the polyamide resin of the embodiments include the following ones.

N-1

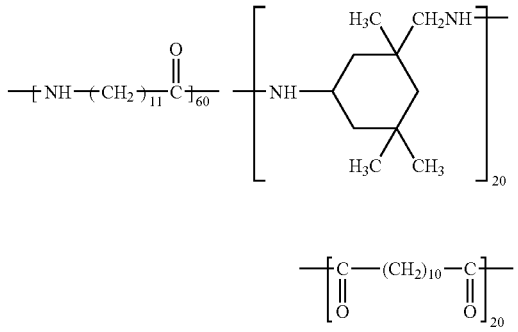

(100%)

N-2

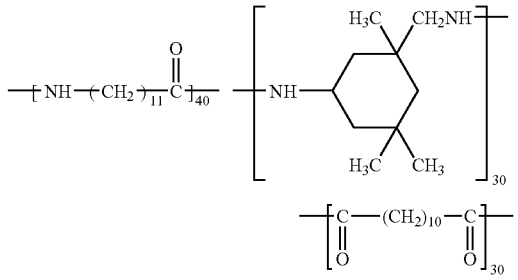

(100%)

N-3

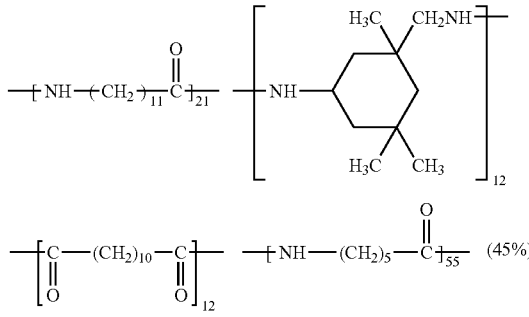

(45%)

-continued

N-4

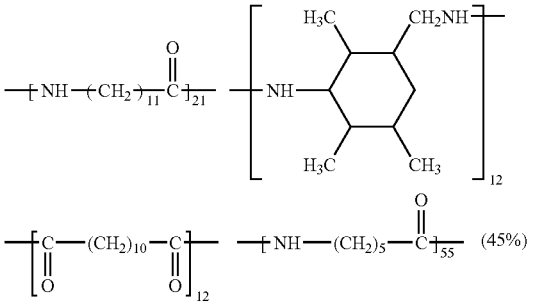

N-5

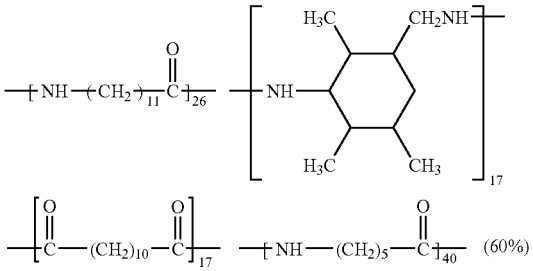

N-6

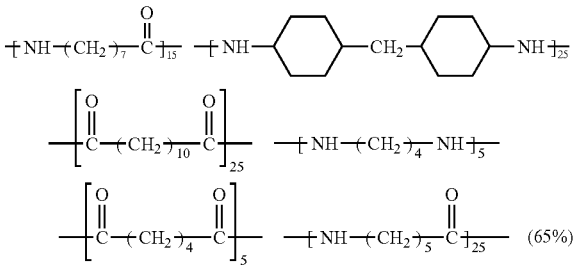

N-7

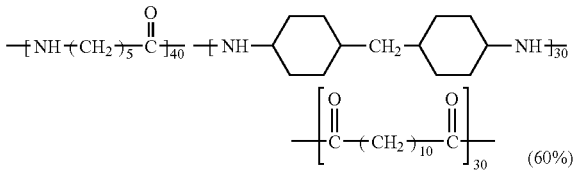

N-8

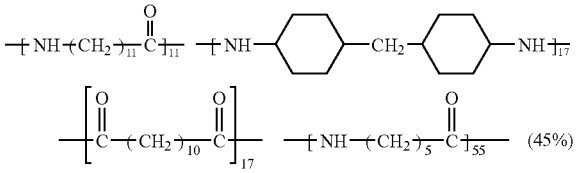

N-9

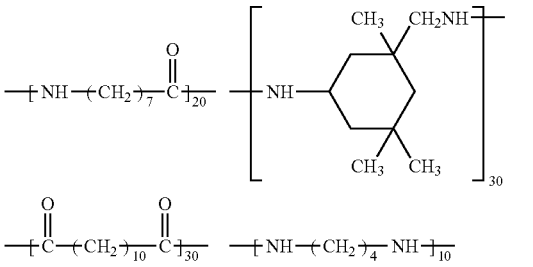

-continued

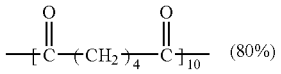

N-10

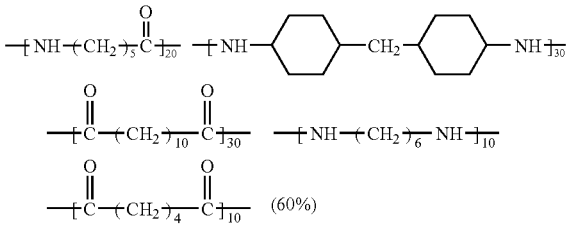

N-11

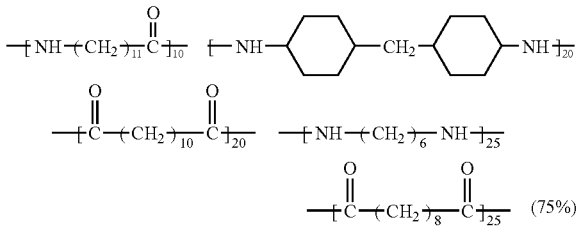

"%" in the parentheses in the above-described specific examples represents a ratio (% by mol) of the repeating unit structure having 7 or more carbon atoms between the amide bonds in the repeating unit structure.

Among the above-described specific examples, polyamide resins in N-1 to N-4 having the repeating unit structure represented by Formula (4) are particularly preferable.

Furthermore, the polyamide resin has preferably a molecular weight of 5,000 to 80,000, more preferably from 10,000 to 60,000, in terms of a number average molecular weight. If the number average molecular weight is 5,000 or less, uniformity of the film thickness in the interlayer is deteriorated and sufficient effects of the present invention are hardly exerted, whereas if it is more than 80,000, solvent solubility of the resin is easily reduced and as a result, an aggregated resin is easily generated in the interlayer and image defects such as black spots are easily caused.

A part of the polyamide resins is already available in the market, is sold by trade names such as VESTAMELT X1010 and X4685 produced by Daicel/Degussa Co., Ltd, and can be prepared by a general polyamide synthesis method. One example of the synthesis methods is given below.

Synthesis of Exemplified Polyamide Resin (N-1)

In a polymerization kettle equipped with a stirrer, nitrogen, a nitrogen induction tube, a thermometer, a dehydration pipe, etc., 215 parts by mass of lauryl lactam, 112 parts by mass of 3-aminomethyl-3,5,5-trimethylcyclohexyl amine, 153 parts by mass of 1,12-dodecanoic dicarboxylic acid and 2 parts by mass of water were mixed and reacted for 9 hours under heating and under pressure while distilling water. The resulting polymerization product was taken out and the copolymerization composition thereof was determined by $C^{13}$-NMR. It was found that its composition corresponded with that of N—1. Incidentally, the melt flow index (MFI) of the synthesized copolymer was 5 g/10 min under conditions of 230° C./2.16 kg.

Preferred examples of a solvent for dissolving the polyamide resin to prepare a coating liquid include alcohols having from 2 to 4 carbon atoms, such as ethanol, n-propanol, iso-propanol, n-butanol, t-butanol and sec-butanol. These alcohols are excellent in view of the solubility of polyamide and the coating property of the coating liquid prepared. These solvents are used in an amount of 30 to 100% by mass, preferably from 40 to 100% by mass, more preferably from 50 to 100% by mass, of the whole solvent. Examples of an auxiliary solvent capable of being used together with the solvent and providing a preferable effect include methanol, benzyl alcohol, toluene, methylene chloride, cyclohexanone and tetrahydrofuran.

On the other hand, the construction of the charge transport layer can be obtained by using a publicly known construction. The charge transport layer must be formed by selecting the charge transport material and the binder appropriately.

For the charge transport materials (CTM), for example, triphenylamine derivatives, hydrazone compounds, styryl compounds, benzidine compounds, butadiene compounds, etc. may be used at the same time. These charge transport materials are usually dissolved in appropriate binder resins to form a layer.

Examples of the resins to be used for charge transport layer (CTL) include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, and a copolymer resin comprising two or more kinds of the repeating unit structures of these resins. Other than these insulating resins, a high molecular organic semiconductor such as poly-N-vinylcarbazole is given.

Polycarbonate resins are most preferable as the binder for these CTLs. The polycarbonate resins are most preferable in terms of improving the dispersibility of the CTM and the electrophotographic properties. The ratio between the binder resins and the charge transport materials is preferably from 10 to 200 parts by mass based on 100 parts by mass of the binder resins.

Further, an antioxidant is preferably incorporated into the charge transport layer. The antioxidants means materials, as representative ones, which minimize or retard the action of oxygen under conditions of light, heat, discharging, etc., with respect to auto-oxidation occurring materials which are present in the electrophotographic photoreceptor or the surface thereof.

Construction of the organic photoreceptor for use in the embodiments is described below.

(Electroconductive Support)

For electroconductive supports for use in the photoreceptor, a sheet-shaped or cylindrical support may either be used. However, a cylindrical electroconductive support is more preferred for making an image forming apparatus small-sized.

The cylindrical electroconductive support means a cylindrical support which is capable of endlessly forming images through its rotation. The electroconductive support having a straightness of 0.1 mm or less and a swing width of 0.1 mm or less is preferred. When the straightness and the swing width exceed these limits, it becomes difficult to form excellent images.

A drum of metal such as aluminum and nickel, plastic drums deposited with aluminum, tin oxide, indium oxide, etc., or paper-plastic drums coated with electroconductive materials can be used for electroconductive materials. The electroconductive supports preferably exhibit a specific resistance of $10^3$ Ω·cm or less at room temperature.

The electroconductive support for use in the embodiments may be one having formed on the surface thereof a sealing treated alumite coating.

(Interlayer)

In the embodiments, an interlayer having the barrier function may be preferably provided between the electroconductive support and the photosensitive layer.

(Photosensitive Layer)

The photosensitive layer for the photoconductor in the embodiments may be of a one-layered structure in which one layer having a charge generating function and a charge transport function is formed on the interlayer, such that the one layer. More preferably, however, the photosensitive layer is of a function-separated structure in which the photosensitive layer is divided into a charge generating layer (CGL) and a charge transport layer (CTL) such that the two layers separately have the respective functions of the photosensitive layer. If the photosensitive layer is of the function-separated structure, it is possible to suppress an increase in rest potential due to repeated use, and it is easy to control other electrophotographic characteristics according to the purpose. Preferably, a photoconductor for negative charging is configured such that a charge generating layer (CGL) is formed on the interlayer, and a charge transport layer (CTL) is disposed on the charge generating layer (CGL). In the case of a photoconductor for positive charging, the order of the layers in the layer structure is reverse to that of the photoconductor for negative charging. The most preferable construction of the photosensitive layer is the function-separated structure of the photoconductor for negative charging.

The photosensitive layer construction of the function-separated negatively chargeable organic photoreceptor is described below.

(Charge Generating Layer)

The charge generating layer comprises charge generating materials (CGM). Binder resins and other additives may be incorporated into the layer as other materials, if desired.

Commonly known charge generating materials (CGM) may be used for charge generating materials (CGM). For example, phthalocyanine pigments, azo pigments, perylene pigments, azulenium pigments, etc. may be used. Among them, CGMs capable of minimizing an increase in residual potential accompanied with the repetition of use are those which comprise a crystal structure capable of forming stable aggregation structure among a plurality of molecules. Specific examples of the CGM include phthalocyanine pigments and perylene pigments, which have a specific crystal structure. For instance, titanyl phthalocyanine having a maximum peak at 27.2° of Bragg angle 2θ with respect to a Cu—Kα line, titanyl phthalocyanine having a remarkable diffraction peak at 7.5° and 28.7° of Bragg angle 2θ with respect to a Cu—Kα line, benzimidazole perylene having a maximum peak at 12.4° of the Bragg angle 2θ with respect to a Cu—Kα line, etc., result in minimum degradation accompanied with the repetition of use, and can minimize the increase in residual potential.

When in the charge generating layer, binders are used as a dispersion media of CGM, known resins may be used as binders. Examples of the most preferable resins include formal resins, butyral resins, silicon resins, silicon modified butyral resins and phenoxy resins. The ratio between binder resins and charge generating materials is preferably from 20 to 600 parts by mass based on 100 parts by mass of the binder resins. By using these resins, it is possible to minimize the increase in residual potential accompanied with the repetition of use. The film thickness of the charge generating layer is preferably from 0.01 to 1 μm. When it is less than 0.01 μm, a sufficient sensitivity characteristic is not obtained and a residual potential readily rises. On the other hand, when it exceeds 1 μm, dielectric breakdown or black spots readily occur.

(Charge Transport Layer)

In the embodiments, the above-described charge transport layer having a film thickness of 5 to 20 μm is used. When the film thickness is less than 5 μm, dielectric breakdown or black spots readily occur, whereas when it exceeds 20 μm, image blurring readily occurs and sharpness is readily deteriorated.

The most preferable layer structure of the photoreceptor is exemplified above, however, a photoreceptor layer structure other than the above-described structure may be used in the embodiments.

Examples of the solvents or dispersion media used to form a layer such as an interlayer, a charge generating layer and a charge transport layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide and methyl cellosolve. The solvents or dispersion media is not limited thereto, however, dichloromethane, 1,2-dichloroethane, methyl ethyl ketone, etc. are preferably used. Further, these solvents may be used individually or in combination of two types or more.

Further, in order to remove foreign objects or aggregates in the coating liquid, the coating liquid of these respective layers is preferably filtered through a metal filter or a membrane filter before the coating step. For example, it is preferable that a pleat type (HDC), a depth type (Profile) or a semidepth type (Profile Star) manufactured by Nihon Poul Co., Ltd. is selected according to characteristics of the coating liquid and filtration is performed.

A dip coating method, a spray coating method, a circular amount regulating type coating method, etc. are used as coating methods to produce the organic electrophotographic photoreceptor. The circular amount regulating type coating method is most preferably used for a protective layer. The circular amount regulating type coating method is detailed in, for example, JP-Tokukaisho58-189061A.

In the image forming apparatus of the embodiments, when using the above-described organic photoreceptor and the developing means having a toner containing volatile materials in the total amount of 350 ppm or less at the same time, formation of image defects such as dielectric breakdown or black spots can be prevented and stable image formation ensuring excellent sharpness can be performed for a long period of time. More specifically, in the organic photoreceptor for use in the contact charging method, charges concentrate at the asperities or contaminants generated on the surface of the organic photoreceptor, and as a result, formation of image defects such as dielectric breakdown or black spots is readily caused and image blurring readily occurs. In order to prevent concentration of charges, which is peculiar to such a contact charging method, it is important to reduce volatile materials in a toner, which cause contaminants or asperities on the surface of the organic photoreceptor, to prevent the generation of asperities or contaminants on the surface of the photoreceptor.

More specifically, the inventors have found that control of the total amount of the volatile materials or the amount of polymerizable monomers remaining in the toner is an important factor in solving problems such as dielectric breakdown readily generated in the image forming apparatus having the contact charging method. In the image forming apparatus using contact charging members, when the contact charging member depresses the residual toner on the organic photoreceptor, toner components, etc. are readily adhered onto the organic photoreceptor. As a result of analysis of attachments on this organic photoreceptor, adhesion of a toner which is high in volatile materials containing polymerizable monomers, etc is found. More specifically, the volatile materials containing polymerizable monomers remaining in the toner are strong in an adhesive force to the organic photoreceptor, which results in insufficient removal of the residual toner on the organic photoreceptor. In particular, in the image forming apparatus having no exclusive cleaning means such as a cleaning blade and recovering the residual toner by developing means, insufficient removal of the residual toner tends to be performed, and as a result, the residual toner adheres onto the photoreceptor, which results in formation of small asperities on the surface of the photoreceptor. Dielectric breakdown readily occurs on the organic photoreceptor due to contact between these asperities formed by the accumulation of the residual toner and the contact charging members. When once the dielectric breakdown occurs, it becomes impossible to use the organic photoreceptor.

As a result of extensive investigations on the residual quantity of volatile materials and polymerizable monomers in the toner, the present inventors have found that when the total quantity of the volatile materials in the toner is 350 ppm or less, preferably from 100 to 300 ppm, and the quantity of the polymerizable monomers in the volatile materials is 50 ppm or less, preferably from 1 to 20 ppm, more preferably from 2 to 10 ppm.

Examples of the volatile materials contained in the toner include an unreacted polymerizable monomer, a chain transfer agent, a by-product produced during the production of toners, and an organic solvent used in the production.

Examples of the polymerizable monomer include polymerizable monomers such as styrene, o-methylstyrene, acrylic acid, methacrylic acid, ethyl acrylate and butyl acrylate, crosslinkable polymerizable monomers such as divinylbenzene and polyethylene glycol dimethacrylate.

Examples of the chain transfer agent include n-octylmercaptan and n-decylmercaptan. Examples of the by-product produced during the production of toners include butanol, dodecanol, dodecanal, acrylic ester and benzaldehyde. Examples of the organic solvent used in the production include benzene, xylene, ethyl benzene, ethyl acetate and butyl acetate.

Examples of the method for reducing the total quantity of the volatile materials and the quantity of the polymerizable monomers to the above-described range include various methods such as a method of simply performing heating, a method of increasing a polymerization time, and a method of increasing the amount of a polymerization initiator. However, when these methods are not perfect, procedure of adding the polymerization initiator in the polymerizing step two or more times, using alkyl mercaptan having from 5 to 10 carbon atoms as a chain transfer agent, performing drying under reduced pressure in the drying step and the like can be taken.

More specifically, the polymerization reaction is performed using a water-soluble polymerization initiator in an aqueous medium. At this time, when radicals supplied by the polymerization initiator are reduced, a polymerization conversion rate of the polymerizable monomer is not improved and a small amount of the polymerizable monomer remains in the end. Therefore, the remaining polymerizable monomer is reduced by adding the polymerization initiator in plural times and supplying radicals in plural times, so that the residual quantity of the volatile materials and the polymerizable monomers can be reduced. More specifically, it is preferable to further add the polymerization initiator at a time when the polymerization conversion rate is improved to 90% or more. The polymerization conversion rate can be measured by the weighing method, based on the relation between the dry mass measured by sampling a given amount of samples during the polymerization, measuring this mass precisely and then, drying the sample, and the charged amount.

The water-soluble polymerization initiator is further added preferably in an amount of 10 to 100% by mass, more preferably from 20 to 80% by mass, of the water-soluble polymerization initiator initially added. When the added amount of the initiator is extremely small, an effect of decreasing the residual amount is not obtained, whereas when it is excessively large, end portion of the polymerization initiator adheres to a terminal group, and as a result, the charging property is affected in some cases.

However, when it is difficult to reduce the amount of the residual volatile materials in the toner to the range only by the above-described method, it is possible to use alkyl mercaptan having from 5 to 10 carbon atoms as the chain-transfer agent used in the polymerizing step and in addition, to perform drying under reduced pressure during the drying step.

The headspace method for use in the quantitative determination of the volatile material and the polymerizable monomer remaining in the toners is a method in which toners are enclosed in an opening/closing vessel, heated at predetermined temperature, a gas in the vessel is swiftly injected into a gas chromatograph under the condition where the vessel is filled with a volatile component and then, the amount of the volatile component is measured. Moreover, mass spectrometry (MS) is also performed. A method for dissolving a binder resin or a toner by a solvent and injecting a generated gas into a gas chromatograph is also well known as a method for measuring impurities derived from a binder resin or a small amount of additives. However, according to this method, a peak of purities or a small amount of the additive components is hidden by a peak of the solvent in some cases, and therefore, the method is not suitable for a measurement of the total amount of the volatile components. In the headspace method, it becomes possible to observe the whole peak of the volatile components by means of the gas chromatograph. Moreover, it becomes possible to impart high accuracy by quantification of the residual components by an analysis method utilizing an electromagnetic interaction.

The measurement method by the headspace method is described in detail below.

<Measuring Method>

1. Collection of Samples

Into a 20 ml headspace vial, 0.8 gram of a sample is collected. The amount of the sample is measured in an increment of 0.01 g (necessary to calculate an area per unit mass). The vial is sealed with a special clean bar and a septum.

2. Heating of Test Sample

A test sample is set in an upright position in a thermostat of 170° C. and heated for 30 minutes.

3. Setting of Conditions for Separation by Gas Chromatograph

DB-624 (an inside diameter of 0.25 mm and a length of 30 m) produced by J&W scientific Co., Ltd. is used as a separation column. This separation column is mounted on a gas chromatograph and helium is let to flow as the carrier at a rate of 50 ml/min. The temperature of the separation column is set at 40° C. and measurement is conducted while raising the temperature up to 260° C. at the rate of 15° C./min. The test sample is held for 5 minutes after the temperature has reached 260° C.

4. Introduction of Test Sample

A sample vial is taken out from the thermostat and 1 ml of the test sample is immediately injected using a gas tight syringe.

5. Calculation

In the present invention, materials detected between a peak of n-hexane and a peak of n-hexadecane are determined as the total quantity of volatile materials.

In the determination of the polymerizable monomer, the polymerizable monomer used in polymerization is employed as a reference material, a calibration curve is previously prepared and the concentration of each component is calculated.

6. Equipment and materials (1) Head Space Conditions

Head space device

HP7694 produced by Agilent Technologies Co.

"Head Space Sampler"

Temperature Conditions

Transfer line: 200° C.

Loop temperature: 200° C.

Sample amount: 0.8 g/20 ml vial (2) GC/MS Conditions

GC: HP5890 produced by Agilent Technologies Co.

MS: HP5971 produced by Agilent Technologies Co.

Column: HP-624 30 m×0.25 mm

Oven temperature: An oven is kept at 40° C. for 3 minutes and then elevated up to 200° C. at a temperature rising rate of 10° C./min over 16 minutes, and then kept at 200° C.

Measurement Mode: SIM

In an actual measurement in the present invention, a premeasurement of n-hexane and n-hexadecane as reference samples is performed in the above-described oven temperature program, and a detection time of a peak of both the materials is previously recognized. Thereafter, the sample measurement is performed in the oven temperature program, and the total peak area of materials detected in the period from the peak detection time of n-hexane to the peak detection time of n-hexadecane is converted using a toluene calibration curve. The peaks of 0.1 ppm or more (ppm means parts per million) expressed in terms of toluene per one peak is adopted as an object. The quantity of the volatile materials and the polymerizable monomers detected during this time are determined. In addition, other apparatuses can be also used when measurement principle and measurement condition can be made the same.

Next, specified compounds are described.

(1) Binder Resin

A binder resin constructing the toner of the embodiments is a resin obtained by polymerizing a polymerizable monomer described below. The resin preferably has a glass transition point of 20 to 90° C., as well as a softening point of 80 to 220° C. The softening point can be measured by an elevated type flow tester. Further, the binder resin preferably has a number average molecular weight (Mn) of 1,000 to 100,000, and a weight average molecular weight (Mw) of 2,000 to 1,000,000, which are measured by gel permeation chromatography.

(2) Colorant

As the colorants constructing the toner of the embodiments, there may be used, for example, various inorganic pigments, organic pigments, and dyes.

As the inorganic pigments, there can be used conventionally known pigments. Examples of the inorganic pigments include the following pigments.

As black pigments, there can be used carbon black, such as furnace black, channel black, acetylene black, thermal black, and lampblack, and further magnetic powders, such as magnetite and ferrite.

The above organic pigments and dyes can be selectively used singly or in combination of a plurality thereof, as required. Further, the amount of organic pigment added is 2 to 20 mass %, preferably 3 to 15 mass %, with respect to the amount of polymer.

When the toner is used as a magnetic toner, it is possible to add the above-mentioned magnetite. In this case, from the viewpoint of giving predetermined magnetic properties, it is preferable to add an amount of 20 to 60 mass % to the toner.

As the organic pigments and the dyes, there can be used conventionally known pigments and dyes. Examples of the organic pigments and the dyes includes the following colorants.

Pigments for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222, and the like.

Pigments for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, C.I. pigment yellow 156, and the like.

Pigments for green or cyan include C.I. pigment blue 15, C.I. pigment blue 15:2, C.I. pigment blue 15:3, C.I. pigment blue 16, C.I. pigment blue 60, C.I. pigment green 7, and the like.

As the dyes, C.I. solvent red 1, 49, 52, 58, 63, 111 and 122, C.I. solvent yellow 19, 44, 77, 79, 81, 82, 93, 98, 103, 104, 112 and 162, C.I. solvent blue 25, 36, 60, 70, 93 and 95, and the like can be used, and mixtures thereof can be also used.

It is possible to select a single or plurality of these organic pigments and dyes and combine if desired. An addition amount of the pigment is from 2 to 20% by weight based on the polymer, and preferably the amount of from 3 to 15% by weight is selected.

The colorant (a colorant particle) constructing the toner of the embodiments may be subjected to a surface modification. A conventionally known surface modifier can be employed as a surface modifier. Specifically, silane coupling agents, titanium coupling agents, aluminum coupling agents, and the like can be preferably employed. Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane. Examples of the titanium coupling agent include those marketed with brand "Plainact" TTS, 9S, 38S, 41B, 46B, 55, 138S, 238S etc., produced by Ajinomoto Corporation, and A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nippon Soda Co., Ltd. Examples of the aluminum coupling agent include "Plainact AL-M", produced by Ajinomoto Corporation.

The added amount of these surface modifiers is preferably from 0.01 to 20% by mass, more preferably from 0.1 to 5% by mass, based on the colorant.

The surface modification of the colorant particle can be performed by adding the surface modifier into the dispersion liquid of the colorant particle and heating the system to conduct reaction.

The surface modified colorant particles are collected by filtration and repeatedly subjected to washing and filtering by the same solvent. Then the colorant particles are dried.

(3) Polymerizable Monomer

A hydrophobic monomer is essentially used as the polymerizable monomer for producing the binder resin and a cross-linkable monomer is used if necessary. As is described below, it is preferable to contain at least one kind of a monomer having an acidic polar group or a monomer having a basic polar group.

(3.1) Hydrophobic Monomer

Conventionally known monomers can be used as the hydrophobic monomer constructing the monomer component without any limitation. One or more kinds of the monomers may be used in combination so as to satisfy the required property.

Specifically, monovinyl aromatic monomers, (meta)acrylate ester monomers, vinyl ester monomers, vinyl ether monomers, monoolefin monomers, diolefin monomers, and halogenated olefin monomers can be used.

Examples of the aromatic vinyl monomers include styrene monomers and derivatives thereof, such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the acrylate monomers include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate.

Examples of the vinyl ester monomers include vinyl acetate, vinyl propionate, and vinyl benzoate.

Examples of the vinyl ether monomers include vinylmethylether, vinylethylether, vinylisobutylether, and vinylphenylether.

Examples of the monoolefin monomers include ethylene, propylene, isobutylene, 1-butene, 1-pentene, and 4-methyl-1-pentene.

Examples of the diolefin monomers include butadiene, isoprene, and chloroprene.

(3.2) Crosslinkable Monomer

A crosslinkable monomer may be added to improve the property of the binder resin. Examples of the crosslinkable monomer include one having two or more unsaturated bonds such as divinylbenzene, divinylnaphthalene, divinyl ether, diethylene glycol methacrylate, ethylene glycol dimethacrylate, poly(ethylene glycol)dimethacrylate and diallyl phthalate.

(3.3) Monomer Having an Acidic Polar Group

Examples of the monomer having an acidic polar group include (a) an α, β-ethylenic unsaturated compound having a carboxyl group (—COOH) and (b) an α, β-ethylenic unsaturated compound having a sulfonic acid group ($—SO_3H$).

Examples of the α, β-ethylenic unsaturated compound of (a) containing a carboxyl group include acrylic acid, methacrylic acid, fumaric acid, maleic acid, itaconic acid, cinnamic acid, monobutyl maleate, and monooctyl maleate, these metal salts formed from sodium, zinc and the like.

Examples of the α, β-ethylenic unsaturated compound containing a sulfonic group include sulfonated styrene, sodium salt thereof, allyl sulfosuccinate, octyl allylsulfosuccinate, sodium salt thereof and the like.

(3.4) Monomer Having a Basic Polar Group

Examples of the monomer having a basic polar group include (i) a methacrylate of an aliphatic alcohol, which has 1 to 12 carbon atoms, preferably 2 to 8 carbon atoms, specifically preferably 2 carbon atoms, and which also has an amino group or a quaternary ammonium group, (ii) a (meth)acrylamide or a (meth)acrylamide optionally substituted by mono- or di-alkyl groups having from 1 to 18 carbon atoms on an N atom, (iii) a vinyl compound substituted by a heterocyclic group having an N atom as the member of the heterocyclic ring, and (iv) a N,N-diallylalkylamine or a quaternary ammonium salt thereof. Among these, the (meth)acrylate of the aliphatic alcohol having an amino group or a quaternary ammonium group of (i) is preferable as the monomer having a basic polar group.

Examples of the (meth)acrylate of the aliphatic alcohol having an amino group or a quaternary ammonium group of (i) include dimethyl-aminoethyl acrylate, dimethylaminoethyl methacrylate, diethylaminoethyl acrylate, diethylaminoethyl methacrylate, quaternary ammonium salts of the above four compounds, 3-dimethylaminophenyl acrylate, 2-hydroxy-3-methacryloxypropyltrimethyl ammonium salt, and the like.

Examples of the (meth)acrylamide or a (meth)acrylamide optionally substituted by mono- or di-alkyl groups on an N atom of (ii) include acryl amide, N-butylacryl amide, N,N-dibutylacryl amide, piperidylacryl amide, methacryl amide, N-butylmethacryl amide, N,N-dimethylacryl amide N-octadecylacryl amide and the like.

Examples of the vinyl compound substituted by a heterocyclic group having an N atom as the member of the heterocyclic ring of (iii) include vinylpyridine, vinylpyrrolidone, vinyl-N-methylpyridinium chloride and vinyl-N-ethylpyridinium chloride.

Examples of the N,N-diallylalkylamine of (iv) include N,N-diallylmethylammonium chloride and N,N-diallylethyl-ammonium chloride.

(4) Polymerization Initiator

As a polymerization initiator for being capable of providing radical according to the embodiments, heretofore known polymerization initiator can be used without being limited especially as long as they are water-soluble. For example, examples of the polymerization initiator include persulfates (potassium persulfate, ammonium persulfate, etc.), azo compounds (for example, 4,4'-azobis4-cyanovaleric acid and salts thereof, 2,2'-azobis(2-amidinopropane) salt, etc.), peroxide compounds and the like. However, the polymerization initiator is not limited thereto. Further, the polymerization initiators can be used as Redox initiators by using them in combination with reducing agents as required. By using the Redox initiators, polymerization activity is increased, whereby it is possible to lower a polymerization temperature. In addition, shortening of a polymerization time period can be expected and it is preferable.

Although any temperature may be selected as the polymerization temperature so long as it is equal to or higher than a lowest radical forming temperature, a temperature within a range of 50° C. to 90° C. is used. However, when a polymerization initiator for starting polymerization at ordinary temperature, e.g. a combination of hydrogen peroxide and a reducing agent (e.g. ascorbic acid) are used, it is also possible to carry out polymerization at room temperature or a temperature higher than the room temperature.

(5) Chain Transfer Agent

As a chain transfer agent according to the embodiments, alkyl mercaptan having 5 to 10 carbon atoms can be used.

Specific examples of the alkyl mercaptan having from 5 to 10 carbon atoms include n-pentylmercaptan, n-hexylmercaptan, n-heptylmercaptan, n-octylmercaptan, n-nonylmercaptan, n-decylmercaptan and 2-ethylhexylmercaptan. However, the alkyl mercaptan is not limited thereto.

The amount of the chain transfer agent used is preferably from 0.01 to 5% by mass, more preferably from 0.05 to 4% by mass, based on the radical polymerizable monomer composition. When the amount used is less than 0.01% by mass, an effect is hardly exerted, whereas when it exceeds 5% by mass, it is not preferable because the chain transfer agent remains in an unreacted state.

(6) Aqueous Medium

The aqueous medium according to the embodiments includes water, organic solvent, or a mixed solution thereof and is preferably an aqueous solvent. The aqueous solvent means a medium comprising from 50% to 100% by mass of water and from 0% to 50% by mass of a water-soluble organic solvent. Examples of the water-soluble organic solvent include methanol, ethanol, iso-propanol, butanol, acetone, methyl ethyl ketone, tetrahydrofuran and the like. An alcoholic organic solvent which does not dissolve the obtained binder resin is preferable.

<<Production Method of Toner>>

Next, the production method of the toner is described.

The toner of the embodiments contains a toner particle comprising a binder resin and a colorant. The toner may contain an external additive such as a lubricant in addition to the toner particle. Further, the toner particle may contain a so-called internal additive such as a charge control agent.

Examples of the toner include a pulverized toner formed by a grinding method, a polymerization toner formed by a suspension polymerization method, a method of aggregating/fusion-adhering emulsion polymerization particles, a dissolution suspension method of dissolving and dispersing binder resins in a solution, and the like. Among these, it is preferable to use the polymerization toner and it is preferable to use aggregating/fusion-adhering emulsion polymerization particles as the production method of the toner, in which a volatile material is hardly allowed to remain in the toner.

An example of the production method of the toner according to the embodiments is described below.

The production process of the toner is principally composed of the following processes:

1: A multi-step polymerization process for producing composite resin particles in which a mold releasing agent and/or crystalline polyester is contained in a portion (in the central portion or the interlayer) other than the outermost layer.

2: A salting-out/fusion-adhering process for forming toner particles by salting-out/fusion-adhering the composite resin particles and colorant particles.

3: A filtering and washing process for separating the toner particles from the dispersion liquid system of the toner particles by filtration and removing the surfactant from the toner particles by washing.

4: A drying process for drying the washed toner particles under reduced pressure, and 5: A process for adding an external additive into the dried toner particles, if necessary.

The processes are each described in detail below.

(1) Multi-step Polymerization Process

The multi-step polymerization process is a process to produce the composite resin particle by forming a covering layer composed of a polymer of the monomer on the surface of a resin particle by the multi-step polymerization method.

In the embodiments, the multi-step polymerization method including a three or more step polymerization method is preferably employed from the viewpoint of the production stability and the crushing strength of the obtained toner.

The two-step polymerization method and the three-step polymerization method, which are representative examples of the multi-step polymerization method, are described below.

(1.1) Two-step Polymerization Method>

The two-step polymerization method is a method for producing a composite resin particle composed of a central portion (a core) formed from a high-molecular weight resin containing a mold releasing agent, and an outer layer (a shell) formed from a low-molecular weight resin. Namely, the composite resin particle produced by the two-step polymerization method is composed of the core and one covering layer.

This method is described in detail. First, a monomer solution is prepared by dissolving the mold releasing agent in a monomer L. The monomer solution is dispersed in a form of oil droplets in an aqueous medium. Then, the aqueous dispersion system is subjected to polymerization treatment (a first polymerization step) to prepare a dispersion liquid of high molecular weight resin particles each containing the mold releasing agent.

Next, a polymerization initiator and the monomer L for forming a low-molecular weight resin are added to the dispersion liquid of the resin particles, and the monomer L is subjected to polymerization treatment (a second polymerization step) in the presence of the resin particles to form a covering layer composed of the low-molecular weight resin (a polymer of the monomer L) onto the surface of the resin particles.

(1.2) Three-step Polymerization Method

The three-step polymerization method is a method for producing a composite resin particle composed of a central portion (a core) formed from a high-molecular weight resin; an interlayer containing a mold releasing agent; and an outer layer (a shell) formed from a low-molecular weight resin. Namely, the composite resin particle produced by the three-step polymerization method is composed of the core and the two covering layers.

This method is described in detail. First, a dispersion liquid of resin particles prepared by polymerization treatment (the first polymerization step) according to a usual procedure is added to an aqueous medium. A monomer solution prepared by dissolving a mold releasing agent in a monomer M is dispersed in a form of oil drops in the aqueous medium. Then, the aqueous dispersion system is subjected to polymerization treatment (the second polymerization step) to form a covering layer (an interlayer) comprising a binder resin (a polymer of the monomer M) containing the mold releasing agent onto the surface of the resin particle (core particle). Thus a dispersion liquid of the composite resin particle (high-molecular weight resin-middle—molecular weight resin) is prepared.

Next, a polymerization initiator and a monomer L for forming a low-molecular weight resin are added to the obtained dispersion liquid of the composite resin particle, and the monomer L is subjected to polymerization treatment (a third polymerization step) in the presence of the composite resin particle to form a covering layer composed of the low-molecular weight binder resin (a polymer of the monomer L) onto the surface of the composite resin particle. It is preferable to incorporate the second polymerization step in the above-described method because the mold releasing agent can be finely and uniformly dispersed.

The polymerization method suitable for forming the resin particle or the covering layer each containing the mold releasing agent includes the following method:

A monomer solution prepared by dissolving the mold releasing agent in the monomer is dispersed in a form of oil droplets in an aqueous medium prepared by dissolving a surfactant in a concentration less than the critical micelle concentration by applying mechanical energy to prepare a dispersion liquid, and a water-soluble polymerization initiator is added to thus obtained dispersion liquid to cause radical polymerization in each of the oil droplets (hereinafter, referred to as a "mini-emulsion method"). This method is preferred because the effect of the present invention can be enhanced. In the method, an oil-soluble polymerization initiator may be used in place of or together with the water-soluble polymerization initiator.

According to the mini-emulsion method for forming oil droplets mechanically, the mold releasing agent dissolved in the oil phase is not released from the oil, unlike a usual emulsion polymerization method. Consequently, a sufficient amount of the mold releasing agent can be introduced in the formed resin particle or the covering layer.

The dispersing machine to be used for carrying out the oil drop dispersion by mechanical energy is not particularly limited. For example, a stirring apparatus "CLEARMIX" (manufactured by M Technique Co., Ltd.) having a high speed rotating rotor, an ultrasonic dispersing machine, a mechanical homogenizer, Manton-Gourin Homogenizer and a pressure homogenizer are usable. The diameter of the dispersed particle is from 10 to 1,000 nm, preferably from 50 to 1,000 nm, more preferably from 30 to 300 nm.

A known polymerization method such as an emulsion polymerization method, a suspension polymerization method and a seed polymerization method may also be employed as other polymerization methods for forming the resin particles or the covering layer each containing the mold releasing agent. These polymerization methods can also be employed for forming the resin particle constructing the composite resin particle (a core particle) or the covering layer each containing no mold releasing agent and no crystalline polyester.

The particle diameter of the composite resin particle produced by this polymerization process is preferably within the range of 10 to 1,000 nm in terms of a mass average particle diameter determined employing an electrophoresis light scattering photometer "ELS-800" (produced by OTSUKA ELECTRONICS Co., Ltd.).

The glass transition temperature (Tg) of the composite resin particle is preferably within the range of 48 to 74° C., more preferably from 52 to 64° C.

The softening point of the composite resin particle is preferably within the range of from 95 to 140° C.

(2) Salting-out/Fusion-adhering Process

The salting-out/fusion-adhering process is a process to obtain a toner particle having an undefined shape (aspherical shape), in which the composite resin particles obtained by the multi-step polymerization process and colorant particles are salted-out/fusion-adhered (the salting-out and fusion-adhering processes are induced simultaneously).

The "salting-out" in the embodiments is a process in which the composite resin particles dispersed in the aqueous solution are aggregated by the effect of a salt. The "fusion-adhering" in the embodiments is a process to disappear the inter-particle surface between the resin particles aggregated by the salting-out. The "salting-out/fusion-adhering" of the embodiments means the sequential occurrence of the salting-out and the fusion-adhering or an action to sequentially induce such processes. For simultaneous occurrence of the salting-out and the fusion-adhering, it is necessary to aggregate the particles (the composite resin particles and the colorant particles) under such a temperature condition as higher than the glass transition temperature (Tg) of the binder resin constructing the composite resin particles.

In the salting-out/fusion-adhering process, particles of internal additives such as a charge control agent (fine particles having a number average primary particle size of about 10 to 1,000 nm) may be salted-out/fusion-adhered together with the composite resin particles and the colorant particles. The colorant particles may be subjected to surface modification. A conventionally known surface modifier can be employed as a surface modifier.

The salting-out/fusion-adhering process is preformed for the colorant particles in a state where the colorant particles are dispersed in an aqueous medium. Preferably, the aqueous medium in which the colorant particles are dispersed is a solution in which the surfactant is dissolved at the concentration more than the critical micelle concentration (CMC).

Although the dispersing machine used in the colorant-dispersing process is not particularly limited, it is preferable to employ pressure dispersing machines such as a stirring apparatus "CLEARMIX" (manufactured by M Technique Co., Ltd.) having a high speed rotating rotor, the ultrasonic wave dispersing machine, the mechanical homogenizer, Manton-Gourin Homogenizer, and the pressure-type homogenizer, a medium-type dispersing machines such as Getzmann Mill and Diamond Fine Mill.

For salting-out/fusion-adhering the composite resin particles and the colorant particles, it is necessary to add a salting-out agent (a coagulant) in a concentration of not less than the critical coagulation concentration into the dispersion liquid in which the composite resin particles and the colorant particles are dispersed, and to heat the dispersion liquid to a temperature not less than the glass transition temperature (Tg) of the composite resin particles.

The temperature range suitable for salting-out/fusion-adhering is from (Tg+10° C.) to (Tg+50° C.), particularly preferably from (Tg+15° C.) to (Tg+40° C.). An organic solvent which is infinitely soluble in water may be added for effective progression of the fusion-adhering.

(3) Filtering and Washing Process

In the filtering and washing process, filtering treatment for separating the toner particles by filtration from the toner particle dispersion system obtained by the above-described process, and washing treatment for removing an adhered substance such as the surfactant and the salting-out agent from the separated toner particles (cakelike aggregate) are applied.

For the filtering treatment, a centrifugal method, a vacuum filtering method using a Nutsche funnel and a filtering method using a filter press are applicable without any limitation.

(4) Drying Process

The process is a process for drying the washed toner particles under reduced pressure.

For a vacuum drier used in this process, for example, a vacuum spray dryer, a vacuum freezing dryer, a vacuum dryer are usable. However, the drier is not limited thereto. More specifically, a fixed rack dryer, a movable rack dryer, a fluid bed dryer, a rotary dryer or a stirring dryer, which is capable of reducing the pressure, is preferably used.

With respect to the conditions at the drying under reduced pressure, the drying temperature may be a temperature not more than the glass transition temperature (Tg) of the binder resin used for the toner, and the degree of pressure reduction, drying time, and the like can be appropriately set without any limitation.

When the dried toner particles are aggregated by a weak attractive force between the particles, the aggregate may be subjected to crushing treatment. For the crushing treatment, a mechanical crushing machine such as a jet mill, a Henschel mixer, a coffee mill and a food processor is usable.

The toner according to the embodiments is preferably produced by the following procedure. Namely, the composite resin particles are prepared in the presence of no colorant and a dispersion liquid of the colorant particle is added to the dispersion liquid of the composite resin particles. Thereafter, the composite resin particles and the colorant particles are salted out/fusion adhered.

In the above-described procedure, the polymerization reaction to form the composite resin particle is not inhibited since the composite resin particle is prepared in a system without the presence of the colorant. Consequently, according to the toner of the embodiments, the excellent anti-offset ability is not deteriorated, and contamination of the fixing device and the image, which is caused by accumulation of the toner, is prevented.

Further, the thus produced toner particle has a uniform surface property and a sharp charging amount distribution. Accordingly, an image with a high sharpness can be formed over a long period of time. By employing such a toner which is uniform in the composition, the molecular weight and the surface property of each toner particles, the anti-offset ability and anti-winding property can be improved and an image with suitable glossiness can be formed while keeping a suitable adhesiveness (a high fixing strength) to the transfer body in the image forming method comprising a fixing process by a contact heating system.

Next, each of the constituents used in the toner production process is described in detail.

(Surfactant)

When using the polymerizable monomer described above to perform, particularly, the mini-emulsion polymerization, it is preferable that the monomer is dispersed in a form of oil droplets in an aqueous solution using a surfactant. Any surfactant can be used without particular limitation. For example, the following ionic surfactants can be cited as examples of suitable compound.

Specific examples of the ionic surfactant include salts of sulfonic acids (sodium dodecylbenzenesulfonate, sodium arylalkylpolyethersulfonate, sodium 3,3-disulfonicdiphenylurea-4,4-diazo-bis-amino-8-naphthol-6-sulfonate, ortho-carboxibenzene-azo-dimethylaniline, sodium 2,2,5,5-tetramethyl-triphenylmethane-4,4-diazo-bis-β-naphthol-6-sulfonate, etc.), salts of sulfuric ester (sodium dodecylsulfate, sodium tetradecylsulfate, sodium pentadecylsulfate, sodium octylsulfate, etc.), salts of fatty acid (sodium oleate, sodium laurate, sodium caprate, sodium caprylate, sodium capronate, potassium stearate and calcium oleate and the like.

A nonionic surfactant can also be used. Specific examples of the surfactant include polyethylene oxide, polypropylene oxide, a combination of polypropylene oxide and polyethylene oxide, ester of polyethylene glycol and higher fatty acid, alkylphenolpolyethylene oxide, ester of higher fatty acid and polyethylene glycol, ester of higher fatty acid and polypropylene oxide, and sorbitan ester.

These surfactants are principally used as an emulsifier at the time of emulsion polymerization and they also may be used in another process or for another object.

(Coagulant)

A coagulant preferably used in the embodiments is selected from the following metal salts.

Examples of the metal salt include univalent metal salts such as salts of alkaline metals, for example, sodium, potassium and lithium, bivalent metal salts such as salts of alkali earth metals, for example, calcium, magnesium, and bivalent metal salts such as salts of manganese and copper, and trivalent metal salts such as salts of iron and aluminum.

Specific examples of these metal salts are described below. Specific examples of the univalent metal salts include sodium chloride, potassium chloride and lithium chloride, that of the divalent metal salts include calcium chloride, zinc chloride, copper sulfate, magnesium sulfate and manganese sulfate and the like, and that of the trivalent metal salts include aluminum chloride, iron chloride and the like. These salts may be optionally selected according to the purpose. Generally, the critical coagulation concentration (coagulation value or coagulation point) of the divalent metal salt is smaller than that of the univalent metal salt, and that of the trivalent metal salt is further small.

The critical coagulation concentration is an index regarding the stability of the dispersion in the aqueous dispersion liquid, and shows the concentration at which aggregation occurs through the addition of coagulants. The critical coagulation concentration markedly varies depending on the latex itself and the dispersing agents. The critical coagulation concentration is described in, for example, Seizo Okamura, et al., "Kobunshi Kagaku (Polymer Chemistry) 17, 601" (1960), and others. Based on the publication, it is possible to know the value of the critical coagulation concentration. Further, as another method, a specified salt is added to a targeted particle dispersion liquid while varying the concentration of the salt, the ζ potential of the resultant dispersion liquid is measured, and the critical coagulation concentration of the salt can be decided according to the salt concentration at which the ζ potential of the dispersion liquid begins to vary.

In the production method of the toner according to the embodiments, the polymer fine particle dispersion liquid is treated using metal salts so that the concentration of the metal salt exceeds the critical coagulation concentration. At this time, it is optionally selected according to the purpose that the metal salt is added directly or in a form of an aqueous solution. When the metal salt is added in the form of an aqueous solution, the added metal salt must satisfy the critical coagulation concentration or more of the polymer particles, based on the total volume of polymer particle dispersion liquid and aqueous metal salt solution.

The concentration of the metal salt used as the coagulant may be any as long as it is larger than the critical coagulation concentration. The added amount of the salt is preferably 1.2 times or more, more preferably 1.5 times or more, of the critical coagulation concentration.

(Mold Releasing Agent)

The toner of the embodiments is preferably one produced by fusion-adhering in the aqueous medium the resin particles including a mold releasing agent. By salting-out/fusion-adhering in the aqueous medium the resin particles including a mold releasing agent with the colorant particles as described above, the toner in which the mold releasing agent is finely dispersed can be produced.

Examples of the mold releasing agent include low molecular weight polypropylene (a number average molecular weight=1,500 to 9,000), low molecular weight polyethylene and the like. Among these, an ester compound represented by the following formula (5) is preferred.

$$R^1\text{—}(OCO\text{—}R^2)_n \qquad \text{General Formula (5)}$$

In the General Formula (5), n represents an integer of 1 to 4, preferably 2 to 4, and more preferably 3 to 4, particularly preferably 4. $R^1$ and $R^2$ represent hydrocarbon groups which may have substituents, respectively. $R^1$ has 1 to 40 carbon atoms, preferably 1 to 20 carbon atoms, more preferably 2 to 5 carbon atoms. $R^2$ has 1 to 40 carbon atoms, preferably 16 to 30 carbon atoms, more preferably 18 to 26 carbon atoms.

Next, typical examples of the compound are shown below.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—(CH_2)_2—CH(CH_3)(CH_3)—CH_2—O—CO—(CH_2)_{22}—CH_3$

9) $CH_3—(CH_2)_{26}—COO—(CH_2)_2—CH(CH_3)(CH_3)—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

16) $CH_3—(CH_2)_{26}—COO—CH_2—C(CH_3)(CH_2—O—CO—(CH_2)_{26}—CH_3)—CH_2—O—CO—(CH_2)_{26}—CH_3$

17) $CH_3—(CH_2)_{20}—COO—CH_2—C(CH_2CH_3)(CH_2—O—CO—(CH_2)_{20}—CH_3)—CH_2—O—CO—(CH_2)_{20}—CH_3$

18) $CH_3—(CH_2)_{26}—COO—CH_2—C(CH_2—O—CO—(CH_2)_{26}—CH_3)(CH_2—O—CO—(CH_2)_{26}—CH_3)—CH_2—O—CO—(CH_2)_{26}—CH_3$

19) $CH_3—(CH_2)_{20}—COO—CH_2—C(CH_2—O—CO—(CH_2)_{20}—CH_3)(CH_2—O—CO—(CH_2)_{20}—CH_3)—CH_2—O—CO—(CH_2)_{20}—CH_3$

-continued

20) $CH_3-(CH_2)_{18}-COO-CH_2-C(CH_2-O-CO-(CH_2)_{18}-CH_3)_3$

21) $CH_3-(CH_2)_{16}-COO-CH_2-C(CH_2-O-CO-(CH_2)_{16}-CH_3)_3$

The added amount of the compound is preferably from 1 to 30% by mass, more preferably from 2 to 20% by mass, still more preferably from 3 to 15% by mass, based on the whole amount of the toner.

(Solvent which is Infinitely Soluble in Water)

The solvent which is infinitely soluble in water is selected from those which do not dissolve the formed binder resins. Specific examples of the solvent include alcohols such as methanol, ethanol, propanol, isopropanol, t-butanol, methoxyethanol, butoxyethanol, nitriles such as acetonitrile; ethers such as dioxane. Among these, ethanol, propanol, and isopropanol are preferred.

(Charge Control Agent)

The toner of the embodiments contains a binder resin and a colorant, and it can also contain a charge control agent and the like, if necessary.

As the charge control agent, various known charge control agents capable of being dispersed in water can be used. Specific examples of the agent include a nigrosine based dye, a metal salt of naphthenic acid or a higher fatty acid, an alkoxylated amine, a quaternary ammonium salt compound, an azo based metal complex and a metal salt of salicylic acid or its metal complex.

(External Additive)

The toner according to the embodiments may be used after adding an external additive to the formed toner so as to allow the external additive to adhere onto the toner surface by a method such as high-speed stirring. When the external additive is allowed to adhere onto the toner surface, more excellent image can be obtained.

Inorganic fine particles or organic fine particles may be used for the external additive. However, the external additive is not limited thereto.

For the inorganic fine particles, inorganic fine particles such as silica, titania, alumina, and the like are preferably used. Further, these inorganic fine particles are preferably subjected to hydrophobic treatment employing silane coupling agents, titanium coupling agents, and the like. The degree of the hydrophobic treatment is not particularly limited, however, the degree is preferably from 40 to 95 in terms of the methanol wettability. The methanol wettability as described herein means a measure for evaluating wettability for methanol. The methanol wettability is measured as follows. 0.2 g of inorganic fine particles to be measured is weighed and added to 50 ml of distilled water, in a beaker having an inner capacity of 200 ml. Methanol is then gradually dripped, while stirring, from a burette whose end portion is immersed in the liquid, until the entire inorganic fine particles are wetted. When the volume of methanol, which is necessary for completely wetting the inorganic fine particles, is represented by "a" ml, the degree of hydrophobicity is calculated based on the following formula.

$$\text{Degree of hydrophobicity}=[a/(a+50)]\times 100$$

For the organic fine particles, styrene resin fine particles, styrene acrylic resin fine particles, polyester resin fine particles, urethane resin fine particles and the like are preferably used.

The added amount of the external additive is preferably from 0.1 to 5.0% by mass, more preferably from 0.5 to 4.0% by mass, of the toner. Further, external additives may be employed in combinations of various types.

(Developer)

The toner of the embodiments may be employed as either a one-component developer or a two-component developer.

The one-component developer includes a non-magnetic one-component developer or a magnetic one-component developer produced by incorporating a magnetic particle having a diameter of from 0.1 to 0.5 μm in the toner particle. Either of the developers can be used.

The toner of the embodiments can be used in the form of a two-component developer by being mixed with a carrier as a magnetic particle. In such a case, known materials, for example, a metal such as iron, ferrite, and magnetite, and an alloy of the foregoing metal with another metal such as aluminum and lead can be used as the carrier. Among these, ferrite particles are preferable. The carrier preferably has a volume average particle diameter of 15 to 100 μm, more preferably from 25 to 80 μm.

The volume average particle diameter of the carrier can be measured typically by a laser-diffraction-type particle diameter distribution measuring apparatus equipped with a wet-type dispersing machine "HELOS" (manufactured by SYMPATEC Corp.).

Further, a carrier having magnetic particles coated with a resin, or a so-called resin dispersion-type carrier having magnetic particles dispersed in a resin can be used as the carrier. For example, olefin resin, styrene resin, styrene-acrylic resin, silicone resin, ester resin, fluorine-containing polymer resin, and the like are included as the coating resin. Further, styrene-acrylic resin, polyester resin, fluorocarbon resin, phenol resin, and the like are included as the resin for forming the resin dispersion-type carrier.

Next, the image forming apparatus using the contact charging method of the embodiments is described.

FIG. 1 is a schematic cross sectional view of an image forming apparatus 1 employing the contact charging method. The image forming apparatus 1 is internally provided with a photoreceptor cartridge 2, a developing cartridge 3, an exposure machine 4 for injecting a laser beam demodulated based on an image signal from outside while deflecting the demodulated beam, a sheet feeder 5 for feeding a recording paper, a transfer roller 6 which is provided so as to face a photoreceptor 21, a fixing device 7 and a paper discharge tray 8.

The photoreceptor cartridge 2 internally has the photoreceptor 21 comprising a cylindrical body having formed on the outer peripheral surface thereof a thin film layer composed of organic photoconductive materials, and a charging brush 22. The developing cartridge 3 internally has a developing sleeve, a stirring roller, and a toner tank holding a toner and a carrier, which are not shown. A developing bias is applied to the developing sleeve from a development power source (not shown). The cartridges of both the photoreceptor cartridge 2 and the developing cartridge 3 are provided with a protective cover (not shown) so as to have a closed state at the attachment to the image forming apparatus 1 and so as to have an open state at the detachment from the image forming apparatus 1, for the purpose of preventing troubles due to the mechanical contact from occurring at the attachment to or detachment from the image forming apparatus 1.

An image forming process is described.

First, the charging brush 22 as charging section contacts with the surface of the photoreceptor 21, and the surface of the photoreceptor 21 is uniformly charged to a predetermined voltage. Then, the exposure machine 4 as exposure section generates a demodulated laser beam (it is indicated by a dashed arrow in the figure), in which this laser beam scans onto the photoreceptor 21 while being deflected by means of a polygon mirror (not shown) to sequentially form on the surface of the photoreceptor 21 an electrostatic latent image in response to image information. At this time, the developing cartridge 3 as developing section stirs a toner within the toner tank by the stirring roller and then, supplies on the developing sleeve to develop the electrostatic latent image on a toner image corresponding to the electrostatic latent image in a facing portion to the photoreceptor 21. At the same time, the developing cartridge 3 recovers toners remaining in an unexposed part (non-image part) on the surface of the photoreceptor 21 by an electrostatic force which utilizes a potential difference between the developing bias voltage applied to the developing sleeve and the surface potential on the photoreceptor 21.

Then, the transfer roller 6 as transfer section electrostatically transfers the toner image on the recording paper used as transfer material. The recording paper is conveyed from the sheet feeder 5 along a carrying path indicated by a solid arrow in the figure. Subsequently, this recording paper is conveyed to the fixing device 7, in which an unfixed toner image is heated and fixed on the recording paper. Lastly, the recording paper on which a desired image has been formed is discharged from the paper discharge tray 8. By repeating a series of the process described above, reproduction of the original can be carried out in large quantity and in a high speed.

On the upstream side of the charging brush 22 which exists in the rotation direction of the photoreceptor 21, a pre-charging film 24 (the film is a sheetlike member to uniformize unevenness in charging on the photoreceptor 21 and to charge the residual toners at the same time: it is auxiliary charging section to charge the toners) for charging the residual toners on the photoreceptor 21 in accordance with charging polarity of the photoreceptor 21, and charge leveling members 25 and 26 (the members are spongelike members to uniformize unevenness in charging by dispersing the residual toners on the photoreceptor 21 and to charge the residual toners at the same time: they are auxiliary charging section to charge the toner) are provided. The charging brush 22, the pre-charging film 24 and the charge leveling members 25 and 26 contact the photoreceptor 21. The charging brush 22 mechanically stirs residual toners conveyed to a contact area with the photoreceptor 21 by the rotation of the photoreceptor 21 and causes the residual toners to diffuse on the surface of the photoreceptor 21 until the toners are made to an unreadable state. The charging brush 22 electrostatically adsorbs and recovers the residual toners having a polarity (reverse polarity) reverse to the charging polarity of the photoreceptor 21 and charges the toners in accordance with charging polarity of the photoreceptor 21 (normal polarity) as the charging polarity of the photoreceptor 21 and ejects the toners onto the surface of the photoreceptor 21.

Figure 2:
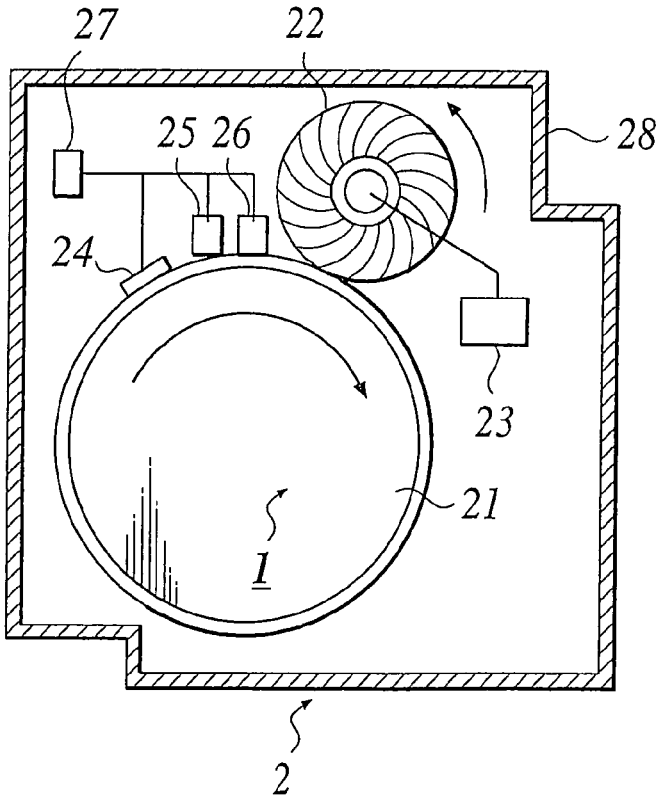
FIG. 2 is a schematic cross sectional view of a photoreceptor cartridge 2 freely attached to/detached from the image forming apparatus 1.

FIG. 2 is a schematic cross sectional view of the photoreceptor cartridge 2 freely attached to/detached from the image forming apparatus 1. The photoreceptor cartridge 2 houses, inside a casing 28 with an openable and closable protective cover (not shown), the photoreceptor 21 as an image carrier, the charging brush 22 contacted and positioned around this photoreceptor 21, a power supply connection member 23 to apply a predetermined voltage to the charging brush 22, the pre-charging film 24, the charging leveling members (spongelike charging members) 25 and 26, and a power supply connection member 27. The casing 28 with the protective cover has an exposure light incident window, a developing section mounting hole and a mechanism in which the protective cover opens at the attachment to the image forming apparatus to allow the photoreceptor and the transfer section to close to or contact with each other (not shown).

The photoreceptor 21 rotates in the direction indicated by an arrow in the figure by a drive unit (not shown). The charging brush 22 is one produced by planting a conductive thread composed of hairy fabric in a brush support. The charging brush 22 rotates in the direction indicated by the arrow in the figure by the drive unit (not shown), that is, in the same direction as the rotative direction of the photoreceptor 21 at the contact area with the photoreceptor 21 while contacting the surface of the photoreceptor 21. When an image is formed, a voltage is applied to the charging brush 22 by the charging power supply (not shown) and thereby, the surface of the photoreceptor 21 is uniformly charged to have a predetermined polarity. On the other hand, when no image is formed, a voltage with a polarity reverse to one at the formation of the image is applied to the charging brush 22 by the charging power supply. The charging polarity of toners is the same as the polarity of the charging voltage at the formation of an image. Therefore, when no image is formed, the toners accumulated in the charging brush 22 can be ejected onto the photoreceptor 21 by an electrostatic repulsion.

The pre-charging film 24 is provided for imparting a normal polarity to the residual toners on the photoreceptor so that the toners are easily recovered by the developing section used as the developing cartridge 3. The charging leveling members 25 and 26 also have the same function as the pre-charging film 24, and at the same time, the members have a function of causing the residual toners to diffuse on the photoreceptor 21 and a function of supplementing unevenness in charging on the photoreceptor 21 by the charging brush 22.

The image forming apparatus 1 is applicable to a black-and-white laser printer and similarly applicable to a color laser printer or copying machine. Further, The image forming apparatus 1 is applicable also to an image forming apparatus for color. More specifically, the image forming apparatus 1 can have a construction which provides a plurality of photoreceptors and a plurality of development apparatuses, a construction which provides the plurality of the development apparatuses around one photoreceptor, a construction which transfers on the transfer material after transferring toner image formed onto the photoreceptor on a middle transcriptional body once, and the like.

For a preferable example of the image forming apparatus 1, a cleaner-less image forming apparatus, that is, one having no cleaning device with a main function of removing or recovering the residual toners on the photoreceptor or having no cleaning member (e.g., cleaning blade, etc.,) is exemplified. However, the image forming apparatus may be an apparatus having a dedicated cleaning section to recover the residual toners. That is, the image forming apparatus 1 is applicable also to an image forming apparatus other than a cleaner-less type image forming apparatus.

EXAMPLE

The present invention is described in detail below by referring to Examples, however, the embodiment of the present invention is not limited thereto. Incidentally, the term of "part" represents "part by mass" in the following sentences.

Photoreceptors for evaluation were prepared as follows.

(1) Preparation of Photoreceptor (1.1) Preparation of Photoreceptor 1

Interlayer 1

On a washed cylindrical aluminum substrate (processed to a surface roughness Rz of 1.0 μm by cutting), the following interlayer coating liquid was coated by a dip coating method so as to form an interlayer 1 having a dry film thickness of 10 μm.

The following interlayer dispersion liquid was diluted twice with the same mixed solvent and filtered (filter; Ridgemesh filter manufactured by Nihon Poul Co., Ltd., nominal filtering precision: 5 μm, pressure; 50 kPa) after standing for one night to prepare an interlayer coating liquid.

| (Preparation of interlayer dispersion liquid) | |
|---|---|
| Binder resin: (Exemplified polyamide N-1) | 1 part |
| Anatase-type titanium oxide Al containing a niobium element in an amount of 0.5% by mass (primary particle diameter: 35 nm, surface treatment: treatment by methylhydrogen polysiloxane) | 3.0 parts |
| Isopropyl alcohol | 10 parts |

The components were mixed and dispersed by a batch method for 10 hours using a sand mill disperser. Thus, an interlayer dispersion liquid was prepared.

Charge Generating Layer

The following components were mixed and dispersed using a sand mill disperser to prepare a charge generating layer coating liquid. This coating liquid was coated on the interlayer by a dip coating method so as to form a charge generating layer having a dry film thickness of 0.3 μm.

| | |
|---|---|
| B-type oxytitanyl phthalocyanine (a titanyl phthalocyanine pigment having a remarkable diffraction peak at Bragg angles (2θ ± 0.2°) of 7.5° and 28.7° in Cu—Kα characteristic X-ray diffraction spectrometry) | 20 parts |
| Polyvinyl butyral (BX-1, produced by Sekisui Chemical Co., Ltd.) | 10 parts |
| Methyl ethyl ketone | 700 parts |
| Cyclohexanone | 300 parts |

Charge Transport Layer

The following components were mixed and dissolved to prepare a charge transport layer coating liquid. This coating liquid was coated on the charge generating layer by a dip coating method so as to form a charge transport layer having a dry film thickness of 15 μm. Thus, a photoreceptor 1 was prepared.

| | |
|---|---|
| Charge transport material (4-methoxy-4'-(4-methyl-α-phenylstyryl) triphenylamine) | 70 parts |
| Polycarbonate resin (IUPILON Z-300, produced by Mitsubishi Gas Kagaku Co., Ltd.) | 100 parts |
| Antioxidant (the following compound A) | 2 parts |
| Tetrahydrofuran/toluene (volume ratio: 8/2) | 750 parts |

(1.2) Preparation of Photoreceptors 2 to 5

Photoreceptors 2 to 5 were prepared in the same manner as in the photoreceptor 1 except that surface roughness Rz of aluminum substrate, particle of interlayer, binder resin, dry film thickness, charge transport material and film thickness of charge transport layer, etc. were changed as shown in Table 1.

Simultaneously with the preparation of the photoreceptors 1 to 5, each interlayer having a dry film thickness of 10 μm was formed by coating each interlayer coating liquid on an aluminum-deposited polyethyleneterephthalate support using the interlayer coating liquid of each photoreceptor and drying the interlayer particles on the same conditions as the drying conditions of the photoreceptor and thereby, preparing a sample for volume resistance measurement. Then, volume resistance of each interlayer was measured. As a result, all the volume resistances of each interlayer in the photoreceptors 1 to 5 were $1\times10^8$ Ω·cm or more.

[Compound A]

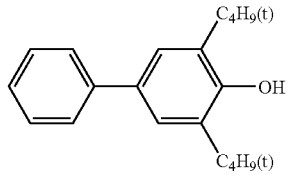

TABLE 1

| | | INTERLAYER | | | | | | | | | |
|---|---|---|---|---|---|---|---|---|---|---|---|
| | | | | | BINDER RESIN | | | | | | |
| PHOTO-RECEPTOR No. | SURFACE ROUGHNESS OF ALUMINUM SUBSTRATE (RZ: μm) | TYPE OF METAL OXIDE PARTICLE AND SURFACE TREATMENT: TYPE OF PARTICLE | PRIMARY PARTICLE SIZE (nm) | SURFACE TREATMENT | TYPE | FUSION HEAT (j/g) | WATER ABSORPTION COEFFICIENT (% by mass) | RATIO OF UNIT STRUCTURE HAVING 7 OR MORE CARBON ATOMS (% by mol) | SOLVENT | FILM THICKNESS (μm) | CHARGE TRANSPORTATION LAYER FILM THICKNESS (μm) |
| 1 | 1.0 | A1 | 35 | *1 | N-1 | 0 | 1.9 | 100 | Isopropyl alcohol | 10 | 15 |
| 2 | 1.0 | A2 | 180 | *2 | N-2 | 0 | 2.0 | 100 | Isopropyl alcohol | 12 | 18 |
| 3 | 1.0 | A3 | 65 | *1 | N-3 | 0 | 2.8 | 45 | Isopropyl alcohol | 18 | 15 |
| 4 | 1.0 | A4 | 15 | *1 | N-6 | 12 | 3.4 | 65 | Isopropyl alcohol/ Butanol(6/1) | 10 | 8 |
| 5 | 1.0 | A1 | 35 | *1 | N-7 | 28 | 3.8 | 60 | Isopropyl alcohol/ Butanol(6/1) | 15 | 10 |

*1: Methylhydrogen polysiloxane
*2: Octyltrimethoxysilane

In Table 1, "A1" represents an anatase-type titanium oxide containing a niobium element in an amount of 0.5% by mass (anatase degree: 100%), "A2" represents an anatase-type titanium oxide containing a niobium element in an amount of 1.0% by mass (anatase degree: 95%), "A3" represents an anatase-type titanium oxide containing a niobium element in an amount of 300 ppm (anatase degree: 100%), and "A4" represents an anatase-type titanium oxide containing a niobium element in an amount of 1.8% by mass (anatase degree: 92%).

In Table 1, "the surface treatment" represents materials used for surface treatment performed on the surface of the particle.

The measurements of heat of fusion and water absorption coefficient in Table 1 were performed as follows.

(Measurement conditions of heat of fusion)

Measuring device: Measurement was performed by use of a "Shimadzu heat flux type differential scanning calorimeter DSC-50" produced by Shimadzu Corporation.

Measurement conditions: The sample to be measured was installed in the measuring device above and then, the measurement was started from a room temperature (24° C.). The temperature was raised to 200° C. at a temperature rising rate of 5° C./min and then cooled to the room temperature at a temperature lowering rate of 5° C./min. This operation was continuously carried out twice and the heat of fusion was calculated from a heat-absorption peak area due to the fusion at the second temperature rising.

(Measurement Conditions of Water Absorption Coefficient)

The sample to be measured was sufficiently dried for 3 to 4 hours at 70 to 80° C. and then, the mass thereof was precisely weighed. Next, the sample was put in ion exchanged water at 20° C. and pulled up after passing a given length of time. Then, water on the surface of the sample was wiped out with a clean cloth to measure the mass. The operation described above was repeated till increase of the mass was saturated. The increased mass (increased portion) of the resultant sample was divided by the initial mass. The value obtained was designated as a water absorption coefficient.

In Table 1, the ratio of a unit structure having 7 or more carbon atoms represents a ratio (% by mol) of a repeating unit structure having 7 or more carbon atoms between the amide bonds in the repeating unit structure.

The toners and the developers using the toners were prepared aside from the photoreceptor.

(2) Preparation of Toner and Developer (2.1) Preparation of Toner Particle (2.1.1) Preparation of Toner Particle 1

<1: Preparation of Core Particle (First Polymerization Step)>

Charged into a 5,000 ml separable flask equipped with a stirring unit, a temperature sensor, a cooling pipe, and a nitrogen gas inlet unit was a surfactant solution prepared by dissolving 7.08 g of an anionic surfactant A ($C_{10}H_{21}(OCH_2CH_2)_2OSO_3Na$) in 3,010 g of ion-exchange water, and the interior temperature was raised to 80° C. under a nitrogen gas flow while stirring at a stirring rate of 230 rpm.

To the surfactant solution, an initiator solution prepared by dissolving 10.0 g of a polymerization initiator (potassium persulfate: KPS) in 300 g of ion-exchange water was added and heated at 75° C. and then, a polymerizable monomer mixture solution composed of 70.1 g of styrene, 19.9 g of n-butyl acrylate, and 10.9 g of methacrylic acid was added dropwise over 1 hour. Polymerization was initiated by stirring the system with heating at 75° C. When a polymerization conversion rate reached 94%, an initiator solution prepared by dissolving 3.0 g of KPS in 100 g of ion-exchange water was further added. Subsequently, polymerization was conducted by stirring the system with heating at 75° C. for 2 hours (the first polymerization step), as a result, a resin particle (a dispersion liquid of resin particle composed of high-molecular weight resins) was prepared. The polymerization conversion rate at this step was 98%. The resulting resin particle was designated as "Resin Particle (1H)".

<2: Formation of Interlayer (Second Polymerization Step)>

A monomer solution 1 was prepared in such a manner that 72.0 g of Exemplified Compound 19) as a mold releasing agent was added to a mixture solution composed of 105.6 g of styrene, 30.0 g of n-butyl acrylate, 15.4 g of methacrylic acid and 5.6 g of n-pentylmercaptan, and the mixture was heated at 80° C. to dissolve the monomers in a flask equipped with a stirring unit. Then, a surfactant solution prepared by dissolving 1.6 g of the anionic surfactant A in 2,700 g of ion-exchange water was heated to 98° C. To the surfactant solution, 28 g (in terms of solid content) of the resin particle (1H) as a dispersion liquid of core particles was added, then the monomer solution 1 prepared as described above was mixed and dispersed by means of a mechanical dispersing machine, "CLEARMIX" (manufactured by M Technique Co., Ltd.) equipped with a circulating pass, and an emulsion containing emulsified particles having a uniform dispersion particle diameter (284 nm) was prepared.

Subsequently, an initiator solution prepared by dissolving 5.0 g of a polymerization initiator (KPS) in 150 g of ion-exchange water, and 750 g of ion-exchange water were added to the emulsion. Polymerization was initiated by stirring the system with heating at 80° C. When a polymerization conversion rate reached 94%, an initiator solution prepared by dissolving 1.5 g of KPS in 50 g of ion-exchange water was further added. Subsequently, polymerization was conducted by stirring the system with heating at 75° C. for 2 hours (the second polymerization step), as a result, a resin particle (a dispersion liquid of composite resin particle having a structure that the surface of resin particle composed of high-molecular weight resins is covered with an intermediate-molecular weight resin) was obtained. The polymerization conversion rate at this step was 98%. The resulting resin particle was designated as "Resin Particle (1HM)".

The "Resin Particle (1HM)" was dried and observed by a scanning electron microscope, as a result, particles (400 to 1000 nm) mainly composed of Exemplified Compound 19 (refer to the above described embodiments), which were not incorporated in the latex particles, were observed.

<3: Formation of Outer Layer (Third Polymerization Step)>

An initiator solution prepared by dissolving 6.8 g of a polymerization initiator (KPS) in 200 g of ion-exchange water was added to the "Resin Particle (1HM)" prepared as described above, then a mixture solution composed of 300 g of styrene, 95 g of n-butylacrylate, 15.3 g of methacrylic acid, and 10.4 g of n-pentylmercaptan was added dropwise over 1 hour at temperature of 80° C. After the completion of dropping the solution, polymerization was initiated by stirring the system with heating at 80° C. When a polymerization conversion rate reached 94%, an initiator solution prepared by dissolving 2.0 g of KPS in 65 g of ion-exchange water was further added. Subsequently, polymerization was conducted by stirring the system with heating at 80° C. for 2 hours (the third polymerization step), and then the mixture solution was cooled to 28° C. Thus a resin particle (a dispersion liquid of composite resin particle having a core part composed of a high-molecular weight resin, an interlayer composed of an middle-molecular weight resin and an outer layer composed of a low-molecular weight resin, in which the Exemplified Compound 19 (refer to the above described embodiments) as a mold releasing agent was incorporated in the interlayer) was obtained. The polymerization conversion rate at this step was 98%. The resulting resin particle was designated as "Resin Particle (1HML)".

<Preparation of Latex (1L)>

An initiator solution prepared by dissolving 14.8 g of a polymerization initiator (KPS) in 400 g of ion-exchange water was charged into a flask equipped with a stirring unit, then a mixture solution composed of 600 g of styrene, 190 g of n-butylacrylate, 30.0 g of methacrylic acid, and 20.0 g of n-pentylmercaptan was added dropwise over 1 hour at temperature of 80° C. Then, polymerization was initiated by stirring the system with heating at 80° C. When a polymerization conversion rate reached 94%, an initiator solution prepared by dissolving 4.4 g of KPS in 200 g of ion-exchange water was further added. Subsequently, polymerization was conducted by stirring the system with heating at 80° C. for 2 hours, and then the mixture solution was cooled to 28° C. Thus latex (a dispersion liquid of resin particle composed of a low-molecular weight resin) was obtained. The polymerization conversion rate at this step was 98%. The resulting latex was designated as "Latex (1L)".

Resin particles constructing the "Latex (1L)" have a peak at a molecular weight of 11,000 in terms of a number average molecular weight (Mn), and a mass average particle diameter of the resin particles was 128 nm.

(Dispersion of Colorant)

Added to 1600 g of ion-exchange water was 90.0 g of anionic surfactant A, which was stirred and dissolved. While stirring the resulting solution, 400 g of C.I. Pigment Blue 15:3 was gradually added, and subsequently dispersed employing a stirring apparatus, "CLEARMIX" (manufactured by M Technique Co., Ltd.). Thus a dispersion liquid of colorant particles (hereinafter, referred to as "Colorant Dispersion Liquid 1") was prepared. A particle diameter of the colorant particles in the "Colorant Dispersion Liquid 1" was measured by employing an electrophoresis light scattering photometer "ELS-800" (manufactured by OTSUKA ELECTRONICS Co.), and it was found to be 110 nm in terms of a mass average particle diameter.

(Aggregation/Fusion-adhering Process)

Charged into a reaction vessel (a four-necked flask) equipped with a temperature sensor, a cooling pipe, a nitrogen gas inlet unit, and a stirring apparatus were 420.7 g (in terms of solid content) of "Resin Particle (1HML)" prepared as described above, 900 g of ion-exchange water, and 166 g of "Colorant Dispersion Liquid 1" prepared as described above, and the resulting mixture was stirred. After adjusting the vessel interior temperature to 30° C., 5 mol/L of an aqueous sodium hydroxide solution was added to the resulting solution, and the pH was adjusted to 9.0.

Subsequently, an aqueous solution prepared by dissolving 12.1 g of magnesium chloride hexahydrate in 1,000 g of ion-exchange water was added under stirring at 30° C. over 10 minutes. After setting the resulting mixture aside for 3 minutes, it was heated so that the temperature was elevated to 90° C. over 60 minutes, and growth of particles was initiated. While maintaining the resulting state, the particle diameter of coalesced particles was measured employing a "Coulter Counter TA-2". When the volume average particle size reached 5.0 mm, the growth of particles was terminated by the addition of an aqueous solution prepared by dissolving 40.2 g of sodium chloride as a terminating agent in 1,000 g of ion-exchange water. Further, fusion-adhering was continuously carried out at a liquid temperature of 98° C. over 2 hours, while performing heating with stirring as a ripening process. Thereafter, it was cooled to 30° C. at a temperature lowering rate of 8° C./min.

(Sharing Process)

To the particles aggregated and fusion-adhered by the above-described process, 96 g of "Latex (1L)" prepared as described above was added and continuously heated with stirring over 3 hours to share the "Latex (1L)" on the aggregated particle surface of the "Resin Particle (1HML). Subsequently, 40.2 g of sodium chloride was added to the mixture solution, and the temperature was cooled to 30° C. at a rate of 8° C./minute. Thereafter, hydrochloric acid was added to the resulting solution, the pH was adjusted to 2.0, and then stirring was terminated.

(Drying Process)

The resulting fusion-adhered particles subjected to sharing process as described above were collected through filtration, and repeatedly washed with ion-exchange water at 45° C. Washed particles were then dried using a vacuum dryer to remove the remaining volatile material and polymerizable monomer in toner particles. Thereafter, the particles were crushed by a Henschel mixer and sieved using a 45 μm mesh sieve to prepare "Toner Particle 1". Drying was performed while reducing the pressure to about 10 kPa and maintaining the state at 45° C. for 10 hours.

(2.1.2) Preparation of Toner Particle 2

"Toner Particle 2" was prepared in the same manner as in the production of "Toner Particle 1" except that n-pentylmercaptan as a chain transfer agent used in preparation of "Toner Particle 1" was changed into n-octylmercaptan.

(2.1.3) Preparation of Toner Particle 3

"Toner Particle 3" was prepared in the same manner as in the production of "Toner Particle 1" except that n-pentylmercaptan as a chain transfer agent used in preparation of "Toner Particle 1" was changed into n-decylmercaptan.

(2.1.4) Preparation of Toner Particle 4

"Toner Particle 4" was prepared in the same manner as in the production of "Toner particle 1" except that the drying temperature in the drying process which has been set in preparation of "Toner Particle 1" was changed from 45° C. to 30° C.

(2.1.5) Preparation of Toner Particle 5

"Toner Particle 5" was prepared in the same manner as in the production of "Toner particle 1" except that the drying time in the drying process which has been set in preparation of "Toner Particle 1" was changed from 10 hours to 5 hours.

(2.1.6) Preparation of Toner Particle 6

"Toner Particle 6" was prepared in the same manner as in the production of "Toner particle 1" except that the drying time in the drying process which has been set in preparation of "Toner Particle 1" was changed from 10 hours to 5 hours and the drying temperature in the drying process was changed from 45° C. to 30° C.

(2.1.7) Preparation of Toner Particle 7

"Toner Particle 7" was prepared in the same manner as in the production of "Toner particle 1" except that the drying time in the drying process which has been set in preparation of "Toner Particle 1" was changed from 10 hours to 20 hours.

(2.1.8) Preparation of Toner Particle 8

"Toner Particle 8" was prepared in the same manner as in the production of "Toner Particle 1" except that preparation of core particles, formation of interlayer, formation of outerlayer and preparation of Latex, which have been set in preparation of "Toner Particle 1", were changed as described below, and the drying time in the drying process which has been set in preparation of "Toner Particle 1" was changed from 10 hours to 20 hours.

<1: Preparation of Core Particle (First Polymerization Step)>

Charged into a 5,000 ml separable flask equipped with a stirring unit, a temperature sensor, a cooling pipe, and a nitrogen gas inlet unit was a surfactant solution prepared by dissolving 7.08 g of an anionic surfactant A ($C_{10}H_{21}(OCH_2CH_2)_2OSO_3Na$) in 3,010 g of ion-exchange water, and the interior temperature was raised to 80° C. under a nitrogen gas flow while stirring at a stirring rate of 230 rpm.

To the surfactant solution, an initiator solution prepared by dissolving 10.0 g of a polymerization initiator (potassium persulfate: KPS) in 300 g of ion-exchange water was added and heated at 75° C. and then, a polymerizable monomer mixture solution composed of 70.1 g of styrene, 19.9 g of n-butyl acrylate, and 10.9 g of methacrylic acid was added dropwise over 1 hour. Polymerization was initiated by stirring the system with heating at 75° C. When a polymerization conversion rate reached 94%, an initiator solution prepared by dissolving 3.0 g of KPS in 50 g of ion-exchange water was further added. Subsequently, polymerization was conducted by stirring the system with heating at 75° C., Subsequently, When a polymerization conversion rate reached 97%, an initiator solution prepared by dissolving 3.0 g of KPS in 50 g of ion-exchange water was further added. polymerization was conducted by stirring the system with heating at 75° C. for 2 hours (the first polymerization step), as a result, a resin particle (a dispersion liquid of resin particle composed of high-molecular weight resins) was prepared. The polymerization conversion rate at this step was 99%. The resulting resin particle was designated as "Resin Particle (8H)".

<2: Formation of Interlayer (Second Polymerization Step)>

A monomer solution 1 was prepared in such a manner that 72.0 g of Exemplified Compound 19) as a mold releasing agent was added to a mixture solution composed of 105.6 g of styrene, 30.0 g of n-butyl acrylate, 15.4 g of methacrylic acid and 5.6 g of n-pentylmercaptan, and the mixture was heated at 80° C. to dissolve the monomers in a flask equipped with a stirring unit. Then, a surfactant solution prepared by dissolving 1.6 g of the anionic surfactant A in 2,700 g of ion-exchange water was heated to 98° C. To the surfactant solution, 28 g (in terms of solid content) of the resin particle (8H) as a dispersion liquid of core particles was added, then the monomer solution 1 prepared as described above was mixed and dispersed by means of a mechanical dispersing machine, "CLEARMIX" (manufactured by M Technique Co., Ltd.) equipped with a circulating pass, and an emulsion containing emulsified particles having a uniform dispersion particle diameter (284 nm) was prepared.

Subsequently, an initiator solution prepared by dissolving 5.0 g of a polymerization initiator (KPS) in 150 g of ion-exchange water, and 750 g of ion-exchange water were added to the emulsion. Polymerization was initiated by stirring the system with heating at 80° C. When a polymerization conversion rate reached 94%, an initiator solution prepared by dissolving 1.5 g of KPS in 25 g of ion-exchange water was further added. Subsequently, polymerization was conducted by stirring the system with heating at 80° C. When a polymerization conversion rate reached 97%, an initiator solution prepared by dissolving 1.5 g of KPS in 25 g of ion-exchange water was further added. Subsequently, polymerization was conducted by stirring the system with heating at 75° C. for 2 hours (the second polymerization step), as a result, a resin particle (a dispersion liquid of composite resin particle having a structure that the surface of resin particle composed of high-molecular weight resins is covered with an intermediate-molecular weight resin) was obtained. The polymerization conversion rate at this step was 98%. The resulting resin particle was designated as "Resin Particle (8HM)".

<3: Formation of Outer Layer (Third Polymerization Step)>

An initiator solution prepared by dissolving 6.8 g of a polymerization initiator (KPS) in 200 g of ion-exchange water was added to the "Resin Particle (8HM)" prepared as described above, then a mixture solution composed of 300 g of styrene, 95 g of n-butylacrylate, 15.3 g of methacrylic acid, and 10.4 g of n-pentylmercaptan was added dropwise over 1 hour at temperature of 80° C. After the completion of dropping the solution, polymerization was initiated by stirring the system with heating at 80° C. When a polymerization conversion rate reached 94%, an initiator solution prepared by dissolving 2.0 g of KPS in 32.5 g of ion-exchange water was further added. Subsequently, polymerization was initiated by stirring the system with heating at 80° C. When a polymerization conversion rate reached 97%, an initiator solution prepared by dissolving 2.0 g of KPS in 32.5 g of ion-exchange water was further added. Subsequently, polymerization was conducted by stirring the system with heating at 80° C. for 2 hours (the third polymerization step), and then the mixture solution was cooled to 28° C. Thus a resin particle (a dispersion liquid of composite resin particle having a core part composed of a high-molecular weight resin, an interlayer composed of an middle-molecular weight resin and an outer layer composed of a low-molecular weight resin, in which the Exemplified Compound 19 as a mold releasing agent was incorporated in the interlayer) was obtained. The polymerization conversion rate at this step was 99%. The resulting resin particle was designated as "Resin Particle (8HML)".

<Preparation of Latex (8L)>

An initiator solution prepared by dissolving 14.8 g of a polymerization initiator (KPS) in 400 g of ion-exchange water was charged into a flask equipped with a stirring unit, then a mixture solution composed of 600 g of styrene, 190 g of n-butylacrylate, 30.0 g of methacrylic acid, and 20.0 g of n-pentylmercaptan was added dropwise over 1 hour at temperature of 80° C. Then, polymerization was initiated by stirring the system with heating at 80° C. When a polymerization conversion rate reached 94%, an initiator solution prepared by dissolving 4.4 g of KPS in 200 g of ion-exchange water was further added. Subsequently, polymerization was conducted by stirring the system with heating at 80° C. When a polymerization conversion rate reached 97%, an initiator solution prepared by dissolving 3.0 g of KPS in 10 g of ion-exchange water was further added. Subsequently, polymerization was conducted by stirring the system with heating at 80° C. for 2 hours, and then the mixture solution was cooled to 28° C. Thus latex (a dispersion liquid of resin particle composed of a low-molecular weight resin) was obtained. The polymerization conversion rate at this step was 99%. The resulting latex was designated as "Latex (8L)".

(2.1.9) Preparation of Toner Particle 9

"Toner Particle 9" was prepared in the same manner as in the production of "Toner Particle 1" except that preparation of core particles, formation of interlayer, formation of outer-layer and preparation of Latex, which have been set in preparation of "Toner Particle 1", were changed as described below.

<1: Preparation of Core Particle (First Polymerization Step)>

Charged into a 5,000 ml separable flask equipped with a stirring unit, a temperature sensor, a cooling pipe, and a nitrogen gas inlet unit was a surfactant solution prepared by dissolving 7.08 g of an anionic surfactant A ($C_{10}H_{21}(OCH_2CH_2)_2OSO_3Na$) in 3,010 g of ion-exchange water, and the interior temperature was raised to 80° C. under a nitrogen gas flow while stirring at a stirring rate of 230 rpm.

To the surfactant solution, an initiator solution prepared by dissolving 9.2 g of a polymerization initiator (potassium persulfate: KPS) in 200 g of ion-exchange water was added and heated at 75° C. and then, a polymerizable monomer mixture solution composed of 70.1 g of styrene, 19.9 g of n-butyl acrylate, and 10.9 g of methacrylic acid was added dropwise over 1 hour. Polymerization (the first polymerization step) was initiated by stirring the system with heating at 75° C. for 2 hours, as a result, a resin particle (a dispersion liquid of resin particle composed of high-molecular weight resins) was prepared. The resulting resin particle was designated as "Resin Particle (9H)".

<2: Formation of Interlayer (Second Polymerization Step)>

A monomer solution 1 was prepared in such a manner that 72.0 g of Exemplified Compound 19) as a mold releasing agent was added to a mixture solution composed of 105.6 g of styrene, 30.0 g of n-butyl acrylate, 15.4 g of methacrylic acid and 5.6 g of n-pentylmercaptan, and the mixture was heated at 80° C. to dissolve the monomers in a flask equipped with a stirring unit. Then, a surfactant solution prepared by dissolving 1.6 g of the anionic surfactant A in 2,700 g of ion-exchange water was heated to 98° C. To the surfactant solution, 28 g (in terms of solid content) of the resin particle (9H) as a dispersion liquid of core particles was added, then the monomer solution 1 prepared as described above was mixed and dispersed by means of a mechanical dispersing machine, "CLEARMIX" (manufactured by M Technique Co., Ltd.) equipped with a circulating pass, and an emulsion containing emulsified particles having a uniform dispersion particle diameter (284 nm) was prepared.

Subsequently, an initiator solution prepared by dissolving 5.1 g of a polymerization initiator (KPS) in 240 g of ion-exchange water, and 750 g of ion-exchange water were added to the emulsion. Polymerization was conducted by stirring the system with heating at 80° C. for 3 hours (the second polymerization step), as a result, a resin particle (a dispersion liquid of composite resin particle having a structure that the surface of resin particle composed of high-molecular weight resins is covered with an intermediate-molecular weight resin) was obtained. The resulting resin particle was designated as "Resin Particle (9HM)".

<3: Formation of Outer Layer (Third Polymerization Step)>

An initiator solution prepared by dissolving 7.4 g of a polymerization initiator (KPS) in 200 g of ion-exchange water was added to the "Resin Particle (9HM)" prepared as described above, then a mixture solution composed of 300 g of styrene, 95 g of n-butylacrylate, 15.3 g of methacrylic acid, and 10.4 g of n-pentylmercaptan was added dropwise over 1 hour at temperature of 80° C. After the completion of dropping the solution, polymerization was conducted by stirring the system with heating at 80° C. for 2 hours (the third polymerization step), and then the mixture solution was cooled to 28° C. Thus a resin particle (a dispersion liquid of composite resin particle having a core part composed of a high-molecular weight resin, an interlayer composed of an middle-molecular weight resin and an outer layer composed of a low-molecular weight resin, in which the Exemplified Compound 19 as a mold releasing agent was incorporated in the interlayer) was obtained. The resulting resin particle was designated as "Resin Particle (9 HML)".

(2.3) Preparation of Developer

A ferrite carrier having a volume average particle diameter of 60 μm, which had been coated with silicon resins, was blended with each of the toners prepared as described above, and Developers 1 to 11 each having a toner concentration of 6% were prepared.

Details of each toner prepared as described above are shown in Table 2.

TABLE 2

| TONER No. | ADDING FREQUENCY OF POLYMERIZATION INITIATOR AT EACH POLYMERIZATION STEP | CHAIN TRANSFER AGENT | DRYING STEP CONDITION | DRYING STEP TEMPERATURE (° C.) | DRYING STEP TIME (h) | TONER AVERAGE PARTICLE DIAMETER (μm) | HEAD SPACE METHOD MEASUREMENT RESULT WHOLE VOLATILE SUBSTANCE (ppm) | HEAD SPACE METHOD MEASUREMENT RESULT POLYMERIZABLE MONOMER (ppm) |
|---|---|---|---|---|---|---|---|---|
| 1 | Twice | n-Pentyl mercaptan | Reduced pressure | 45 | 10 | 5.0 | 260 | 19 |
| 2 | Twice | n-Octyl mercaptan | Reduced pressure | 45 | 10 | 4.8 | 200 | 14 |
| 3 | Twice | n-Decyl mercaptan | Reduced pressure | 45 | 10 | 4.8 | 105 | 11 |
| 4 | Twice | n-Pentyl mercaptan | Reduced pressure | 30 | 10 | 5.0 | 295 | 25 |
| 5 | Twice | n-Pentyl mercaptan | Reduced pressure | 45 | 5 | 5.1 | 305 | 35 |
| 6 | Twice | n-Pentyl mercaptan | Reduced pressure | 30 | 5 | 5.0 | 345 | 48 |
| 7 | Twice | n-Pentyl mercaptan | Reduced pressure | 45 | 20 | 4.8 | 95 | 2 |
| 8 | Three times | n-Pentyl mercaptan | Reduced pressure | 45 | 20 | 4.8 | 25 | 1 |
| 9 | Once | n-Pentyl mercaptan | Reduced pressure | 45 | 10 | 5.1 | 355 | 55 |
| 10 | Twice | n-Dodecy mercaptan | Reduced pressure | 45 | 10 | 5.0 | 530 | 60 |
| 11 | Twice | n-Pentyl mercaptan | Ordinary pressure | 45 | 10 | 5.0 | 600 | 100 |

<Preparation of Latex (9L)>

An initiator solution prepared by dissolving 14.8 g of a polymerization initiator (KPS) in 400 g of ion-exchange water was charged into a flask equipped with a stirring unit, then a mixture solution composed of 600 g of styrene, 190 g of n-butylacrylate, 30.0 g of methacrylic acid, and 20.0 g of n-pentylmercaptan was added dropwise over 1 hour at temperature of 80° C. After completion of dropping, polymerization was conducted by stirring the system with heating at 80° C. for 2 hours, and then the mixture solution was cooled to 28° C. Thus latex (a dispersion liquid of resin particle composed of a low-molecular weight resin) was obtained. The resulting latex was designated as "Latex (9L)".

(2.1.10) Preparation of Toner Particle 10

"Toner Particle 10" was prepared in the same manner as in the production of "Toner Particle 1" except that n-pentylmercaptan as a chain transfer agent used in preparation of "Toner Particle 1" was changed into n-dodecylmercaptan.

(2.1.11) Preparation of Toner Particle 11]

"Toner Particle 11" was prepared in the same manner as in the production of "Toner Particle 1" except that reduced pressure condition (about 10 kPa) in the drying process, which has been set in preparation of "Toner Particle 1" above, was changed into normal pressure condition.

(2.2) Preparation of Toner

Into each of the "toner particles 1 to 11" prepared as described above, 1.0% by mass of hydrophobic silica (a number average primary particle diameter: 12 nm, a degree of hydrophobicity: 68) and 1.2% by mass of hydrophobic titanium oxide (a number average primary particle diameter: 20 nm, a degree of hydrophobicity: 63) were added and mixed by use of a Henschel mixer. Thus, "Toner Particles 1 to 11" were prepared.

(3) Evaluation

The thus obtained Photoreceptors 1 to 5 and Developers 1 to 11 were combined as shown in Table 3 and each combination was installed in EPSON LP-2400 (manufactured by Epson: a printer for A4 size paper 16 sheets/minute) fundamentally having the structure described in FIGS. 1 and 2. Evaluation was performed by changing the evaluation items under respective environments of high temperature and high humidity (30° C. and 80% RH), and low temperature and low humidity (10° C. and 20% RH). The evaluation results are shown in Table 3.

Charging Conditions

Pre-charging film: 800 to 850 V

Charge leveling member: 800 to 850 V

Brush charging member: 800 to 850 V

Exposure Conditions

Target of exposed portion potential: The exposure amount was set such that the exposed portion potential was made to less than −50 V.

Exposure beam: Image exposure having a dot density of 600 dpi (dpi means the number of dots per 2.54 cm) was carried out. A semiconductor laser with a wavelength of 780 nm was used as a laser.

Development conditions: Reversal development using a non-magnetic one-component developer.

(3.1) Evaluation of residual Potential (Potential Change in Solid Black Image)

Under the environments of low temperature and low humidity (LL: 10° C. and 20% RH) and high temperature and high humidity (HH: 30° C. and 80% RH), 10,000 prints were performed under a single sheet intermittent mode, using an A4 size image including a character image with a pixel ratio of 7%, a half tone image, a solid white image and a solid black image each occupying ¼ area of the image. Thereafter, the initial print and the 10,000th print were evaluated on the potential change (|ΔV|) in the solid black image portion at the development position. As the |ΔV| is smaller, increase in the residual potential accompanied with the repetition of use is smaller.

A: Potential change |ΔV| in a solid black image portion was less than 50 V (Good).

B: Potential change |ΔV| in a solid black image portion was from 50 V to 150 V.

C: Potential change |ΔV| in a solid black image portion was more than 150 V.

(3.2) Evaluation of Charged Potential (Potential Change in a Solid White Image)

Under the environments of low temperature and low humidity (LL: 10° C. and 20% RH) and high temperature and high humidity (HH: 30° C. and 80% RH), 10,000 prints were performed under a single sheet intermittent mode, using an A4 size image including a character image with a pixel ratio of 7%, a half tone image, a solid white image and a solid black image each occupying ¼ area of the image. Thereafter, the initial print and the 10,000th print were evaluated on the potential change (|ΔV|) in the solid white image portion at the development position. As the |ΔV| is smaller, change in the charged potential accompanied with the repetition of use is smaller.

A: Potential change |ΔV| in a solid black image portion was less than 50 V (Good).

B: Potential change |ΔV| in a solid black image portion was from 50 V to 150 V.

C: Potential change |ΔV| in a solid black image portion was more than 150 V.

(3.3) Image Evaluation (3.1.1) Image Density: Evaluation under the low temperature and low humidity environment (LL: 10° C. and 20% RH) and the high temperature and high humidity environment (HH: 30° C. and 80% RH)

The measurement was performed using RD-918 manufactured by Macbeth Co., Ltd. Assuming that the reflection density of paper was set at "0", the image density was measured by the relative reflection density. As the residual potential more increases due to a number of copies, the image density more decreases. The measurement was carried out at the solid black image portion after 10,000 copies were each taken.

A: Solid black image was more than 1.2 under both the low temperature and low humidity environment and the high temperature and high humidity environment (Good).

B: Solid black image was from 1.0 to 1.2 under both the low temperature and low humidity environment and the high temperature and high humidity environment.

C: Solid black image was less than 1.0 under any one of the low temperature and low humidity environment and the high temperature and high humidity environment.

(3.3.2) Fog density: Evaluation under the low temperature and low humidity environment (LL: 10° C. and 20% RH) and the high temperature and high humidity environment (HH: 30° C. and 80% RH).

The fog density was measured in such a manner that the solid white image was determined by the reflection density using RD-918 manufactured by Macbeth Co., Ltd. The reflection density was evaluated by the relative density (assuming that the density of A4 size paper not copied was set at 0.000). The measurement was carried out at the solid black image portion after 10,000 copies were each taken.

A: Density was less than 0.010 under both the low temperature and low humidity environment and the high temperature and high humidity environment (Good).

B: Density was from 0.010 to 0.020 under both the low temperature and low humidity environment and the high temperature and high humidity environment.

C: Density was more than 0.020 under any one of the low temperature and low humidity environment or the high temperature and high humidity environment.

(3.3.3) Dielectric Breakdown: Evaluation was performed under the low temperature and low humidity environment (LL: 10° C. and 20% RH) and the high temperature and high humidity environment (HH: 30° C. and 80% RH).

B: No dielectric breakdown of the photoreceptor due to charging leak was generated under the low temperature and low humidity environment or the high temperature and high humidity environment.

C: Dielectric breakdown of the photoreceptor due to charging leak was generated under the low temperature and low humidity environment or the high temperature and high humidity environment.

(3.3.4) Periodic Image Defects (Under High Temperature and High Humidity Environment (HH: 30° C. and 80% RH))

Periodic image defects were evaluated in such a manner that how many visible image defects such as black spot or black streak having periodicity agreeing with the period of the photoreceptor were formed on the A4 size paper.

A: Frequency of the image defects having a longer axis diameter of 0.4 mm or more: 5 or less image defects/A4 in all the copies (good).

B: Frequency of the image defects having a longer axis diameter of 0.4 mm or more: One or more copies each having the image defects of from 6 to 10 per A4 size paper were produced.

C: Frequency of the image defects having a longer axis diameter of 0.4 mm or more: One or more copies each having the image defects of 11 or more per A4 size paper were produced.

(3.3.5) Sharpness

Sharpness of the images was evaluated with character deformation of the images formed under both the environments of low temperature and low humidity (10° C. and 20% RH) and high temperature and high humidity (30° C. and 80% RH). 3 point and 5 point character images were formed and evaluated based on the following judgment criteria.

A: No image blurring was formed. Both of 3 point and 5 point character images were clear and could be easily read.

B: Image blurring was slightly formed. A part of 3 point character images could not be read, and 5 point character images were clear and could be easily read.

C: Image blurring was formed. 3 point character images could scarcely be read, and a part or the whole of 5 point character images could not be read.

TABLE 3

| COMBINATION No. | DEVELOPER No. (LT-No.) | PHOTORECEPTOR No. | POTENTIAL EVALUATION (RESIDUAL POTENTIAL) LL | HH | POTENTIAL EVALUATION (CHARGING POTENTIAL) LL | HH | IMAGE EVALUATION IMAGE DENSITY | FOG | DIELECTRIC BREAKDOWN | BLACK SPOT | SHARPNESS |
|---|---|---|---|---|---|---|---|---|---|---|---|
| 1 | 1 | 1 | A | A | A | A | A | A | B | A | A |
| 2 | 2 | 1 | A | A | A | A | A | A | B | A | A |
| 3 | 3 | 1 | A | A | A | A | A | A | B | A | A |
| 4 | 4 | 1 | B | B | A | A | B | A | B | A | B |
| 5 | 5 | 1 | B | B | A | A | B | A | B | A | B |
| 6 | 6 | 1 | B | B | B | B | B | B | B | A | B |
| 7 | 7 | 1 | A | A | A | A | A | A | B | A | A |
| 8 | 8 | 1 | A | A | A | A | A | A | B | A | A |
| 9 | 9 | 1 | B | B | A | A | B | B | C | B | B |
| 10 | 10 | 1 | B | B | B | B | B | B | C | C | C |
| 11 | 11 | 1 | B | B | B | B | B | B | C | C | C |
| 12 | 3 | 2 | A | A | A | A | A | A | B | A | A |
| 13 | 3 | 3 | A | A | A | A | A | A | B | A | A |
| 14 | 3 | 4 | A | A | A | A | A | A | B | A | A |
| 15 | 3 | 5 | A | A | A | B | A | B | B | B | B |

As is apparent from Table 3, No. 1 to 8 and 12 to 15 combinations are excellent in the stability of residual potential and charged potential under the high temperature and high humidity environment and the low temperature and low humidity environment and therefore, the image density is sufficiently high and the fog density is low. Moreover, dielectric breakdown is not generated and improvement effects on black spot, etc. are remarkable, as a result, an electrophotographic image having excellent sharpness is obtained. Particularly, Nos. 1 to 3, 7, 8, and 12 to 14 combinations of an organic photoreceptor having an interlayer comprising an anatase-type titanium oxide containing a niobium element in a metal oxide particle and a polyamide resin having a fusion heat of from 0 to 20 J/g or less and a water absorption coefficient of 4% by mass or less, and a toner containing volatile materials in the total amount of 300 ppm or less and a polymerizable monomer in an amount of 20 ppm or less are remarkable in the improvement effects on respective evaluation items. On the other hand, No. 9 combination comprising a toner containing volatile materials in the total amount exceeding 350 ppm results in occurrence of dielectric breakdown, and Nos. 10 and 11 combinations result in frequent occurrence of black spot in addition to dielectric breakdown and deterioration in sharpness.

In the image forming apparatus and the image forming method (No. 1 to 8 and 12 to 15 combinations) shown in the above-described examples, elevation of a residual potential or fluctuation of a charged potential which was readily generated by using the contact charging method under a low temperature and low humidity environment or a high temperature and high humidity environment was prevented, or dielectric breakdown or an image defect was prevented, and as a result, an electrophotographic image which is excellent in image density, fog and sharpness could be provided.

The entire disclosure of Japanese Patent Application No. Tokugan 2003-325886 filed on Sep. 18, 2003 including a specification, claims, drawings, and summaries are incorporated herein by reference in their part.

What is claimed is:

1. An image forming method comprising:

Charging a photoreceptor by contacting with a charging section on the photoreceptor, wherein the photoreceptor comprising an electroconductive support; a photosensitive layer and an interlayer located between the electroconductive support and the photosensitive layer, the interlayer containing a metal oxide;

forming a static latent image on the photoreceptor by an exposure;

forming a toner image on the photoreceptor by a toner comprising a toner particle containing a binder resin and a colorant, in which a total amount of a volatile material measured by a headspace method is 350 ppm or less; and transferring the toner image on a transfer material.

2. The method of claim 1, wherein an auxiliary charging section disposed in an upstream from the charging section charges the toner.

3. The method of claim 1, wherein a quantity of a polymerizable monomer of the toner is 50 ppm or less.

4. The method of claim 1, wherein the photosensitive layer comprises a charge generating layer and a charge transport layer, and wherein the interlayer contains particles which includes the metal oxide comprising at least one kind of particle selected from $TiO_2$, $ZrO_2$, ZnO, and $Al_2O_3$.

5. The method of claim 4, wherein a number average primary particle diameter of the particles is from 5 to 400 nm.

6. The method of claim 4, wherein the interlayer contains a polyamide resin having heat of fusion of 0 to 40 J/g and a water absorption coefficient of 5% by mass or less.

7. The method of claim 4, wherein a volume resistivity of the interlayer is $10_8$ Ω·cm or more.

8. The method of claim 4, wherein the thickness of the interlayer is from more than 5 to 25 μm, and the thickness of the carrier transport layer is 5 to 20 μm.

9. The image forming method of claim 1, wherein the toner is a polymerization toner.

10. The method of claim 9, wherein a quantity of a polymerizable monomer of the toner is 50 ppm or less.

11. The method of claim 9, wherein the photosensitive layer comprises a charge generating layer and a charge transport layer, and wherein the interlayer contains particles which includes the metal oxide comprising at least one kind of particle selected from $TiO_2$, $ZrO_2$, ZnO, and $Al_2O_3$.

12. The method of claim 11, herein a number average primary particle diameter of the particles is from 5 to 400 nm.

13. The method of claim 11, wherein the interlayer contains a polyamide resin having heat of fusion of 0 to 40 J/g and a water absorption coefficient of 5% by mass or less.

14. The method of claim 11, wherein a volume resistivity of the interlayer is $10^8$ Ω·cm or more.

15. The method of claim 11, wherein the thickness of the interlayer is from more than 7 to 15 μm, and a thickness of the carrier transport layer is 8 to 18 μm.

16. The method of claim 11, wherein the toner contains the volatile material in a total amount of 100 to 300 ppm measured by a headspace method and polymerizable monomers in an amount of 2 to 10 ppm.

17. The method of claim 9, wherein the thickness of the interlayer is from more than 5 to 25 μm, and the thickness of the carrier transport layer is 5 to 20 μm.

18. The method of claim 9, wherein the metal oxide comprises anatase titanium oxide having a niobium element.

19. The method of claim 9, wherein the toner contains the volatile material in a total amount of 100 to 300 ppm measured by a headspace method and polymerizable monomers in an amount of 1 to 20 ppm.

20. The method of claim 1, wherein the metal oxide comprises anatase titanium oxide having a niobium element.

* * * * *